US008079586B2

(12) United States Patent
Watanabe et al.

(10) Patent No.: US 8,079,586 B2
(45) Date of Patent: Dec. 20, 2011

(54) FEED DEVICE AND IMAGE FORMING APPARATUS

(75) Inventors: Keiichi Watanabe, Tokyo (JP); Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 137 days.

(21) Appl. No.: 12/415,024

(22) Filed: Mar. 31, 2009

(65) Prior Publication Data

US 2009/0267293 A1 Oct. 29, 2009

(30) Foreign Application Priority Data

Apr. 24, 2008 (JP) ..... 2008-114422
Jul. 25, 2008 (JP) ..... 2008-191767

(51) Int. Cl.
*B65H 1/00* (2006.01)

(52) U.S. Cl. ..... 271/162; 271/145

(58) Field of Classification Search ..... 271/109, 271/162, 163, 164, 117, 145
See application file for complete search history.

(56) References Cited

U.S. PATENT DOCUMENTS

| | | | | |
|---|---|---|---|---|
| 5,265,859 | A * | 11/1993 | Watson et al. | 271/109 |
| 5,709,380 | A * | 1/1998 | Petocchi et al. | 271/125 |
| 7,025,345 | B2 * | 4/2006 | Frazier et al. | 271/109 |
| 2002/0190460 | A1 * | 12/2002 | Gaarder et al. | 271/117 |
| 2007/0145666 | A1 * | 6/2007 | Nishikata et al. | 271/18 |

FOREIGN PATENT DOCUMENTS

| | | | |
|---|---|---|---|
| JP | 2000-128368 | A | 5/2000 |
| JP | 2000-255802 | A | 9/2000 |
| JP | 2001-026325 | A | 1/2001 |
| JP | 2006-027746 | A | 2/2006 |

* cited by examiner

*Primary Examiner* — Kaitlin Joerger
(74) *Attorney, Agent, or Firm* — Panitch Schwarze Belisario & Nadel LLP

(57) ABSTRACT

A feed device includes a shaft, a roller member, and a cover member. The shaft is rotatably supported. The roller member engages with one end portion of the shaft through an engagement and disengagement member. The cover member covers the roller member in an openable and closable manner and supports the roller member. The engagement and disengagement member engages and disengages, corresponding to opening and closing of the cover member, the shaft with the roller member.

12 Claims, 35 Drawing Sheets

FEED DEVICE AND IMAGE FORMING APPARATUS

BACKGROUND OF THE INVENTION

1. Field of the Invention

The present invention relates to a feed device and to an image forming apparatus such as a photocopier, a printer, and a facsimile machine including the feed device. More particularly, the present invention relates to replacement of a feed device, or feed rollers.

2. Description of Related Art

A related art image forming apparatus forming an image on a recording medium includes a feed device separating plural recording media stacked on a medium tray sheet by sheet and feeding each of the recording media toward an image forming unit. A feed roller is generally used for such separation of the recording media by the feed device. The feed roller is rotated by prescribed power supplied from a power source and contacts an uppermost recording medium, thereby separating the plural recording media sheet by sheet. A surface of the feed roller is made of, for example, a rubber material having a high friction coefficient such that no slide occurs between the surface of the feed roller and the recording medium by friction force. In a case where such a feed roller is used to feed the recoding medium, the feed roller is not only abraded but also conveyability thereof is deteriorated over time due to adhesion and accumulation of dust of the recording media and conveyance of the recording media using the friction force. Consequently, in a case where the feed roller is deteriorated over time, the feed roller needs to be replaced. In addition, for example, a feed device of recent years is expected to have a long life span from an environmental standpoint, and the replacement of only an abraded feed roller having the deteriorated conveyability enhances a reduction of the environmental load.

The replacement of a consumable item such as the feed roller is generally performed by a repair service person. A user of the related art image forming apparatus, however, is expected to replace the consumable item to meet a recent demand of labor saving, cost reduction, and promptness, for example. Here, the replacement of the consumable item needs to be easy so that a user having a lack of machine knowledge can perform the replacement. The replacement of the consumable item of the related art image forming apparatus, however, consumes the time due to complexity of replacement work or due to necessity of disassembling elements although the consumable item is easily detached from a unit body. In addition, in a case where the unit body as a whole is replaced, a cost is increased.

For example, each of Japanese Un-examined Patent Application Publications No. 2000-128368 (Patent Document 1) and No. 2001-26325 (Patent Document 1) discloses a feed device having a feed roller capable of being replaced easily.

The feed device disclosed in the patent document 1 includes bearings disposed both ends thereof, and each of the bearings includes an opening in a circumference direction thereof such that the feed roller is detachable with respect to a bracket having a fastener by a snap-fit method. Herein, the snap-fit method is used in a case where a component is attached to a resin member. For example, the fastener sized smaller than the component is disposed on the side of the resin member, and the component is attached to the resin member by the fastener serving as a spring upon insertion of the component in the fastener. The feed roller attached by such a method engages with a shaft connected to a power source disposed parallel thereto, thereby being rotatable.

Since the power is supplied to the feed roller through the shaft in the feed device disclosed in the document 1, the shaft needs a gear on the side of at another shaft, causing complexity of the feed device. Moreover, since the feed device is detachably disposed by the snap-fit method, the bearing is applied with an excess load.

In the feed device disclosed in the patent document 2, each phase of a drive connection unit needs to be congruent one another in a case of attaching the feed roller, causing difficulty of replacing the feed roller. The patent document 2 also discloses a method for controlling the feed roller with respect to each rotation. However, in a case where the feed device halts in a state that the phases of the connection unit are not congruent, the feed roller cannot be replaced. Such control of the feed roller with respect to each rotation allows a conveyance distance for one feeding operation to be constant, causing an increase in difficulty of feeding the recording media having different sizes or a slippery recording media having a low friction coefficient. Consequently, design flexibility of the feed device becomes limited.

The present invention provides a feed device having a feed roller capable of being replaced easily with a simple structure and reducing occurrences of applying an excess load to a bearing. Moreover, the present invention provides an image forming apparatus having such a feed device.

BRIEF SUMMARY OF THE INVENTION

According to one aspect of the invention, a feed device includes: a shaft being rotatably supported; a roller member engaging with one end portion of the shaft through an engagement and disengagement member; and a cover member covering the roller member in an openable and closable manner and supporting the roller member. The engagement and disengagement member engages and disengages, corresponding to opening and closing of the cover member, the shaft with the roller member.

According to another aspect of the present invention, an image forming apparatus includes a feed device. The feed device includes: a shaft being rotatably supported; a roller member engaging with one end portion of the shaft through an engagement and disengagement member; and a cover member covering the roller member in an openable and closable manner and supporting the roller member. The engagement and disengagement member engages and disengages, corresponding to opening and closing of the cover member, the shaft with the roller member.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
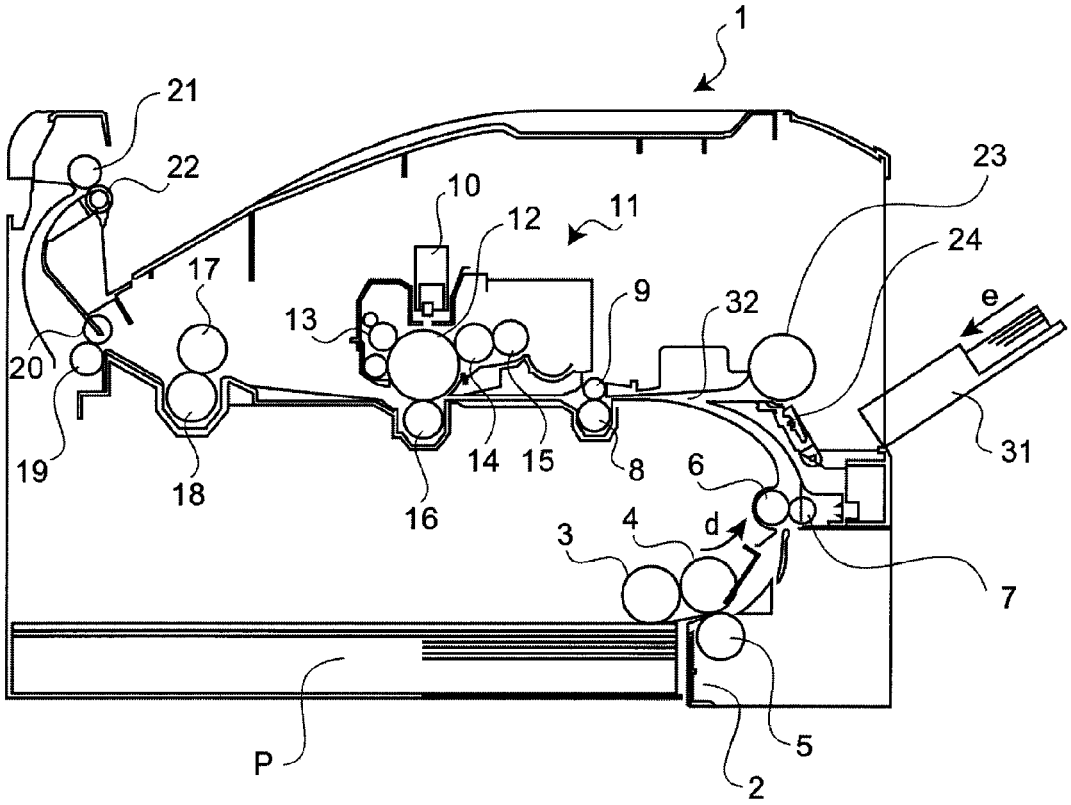
FIG. 1 is a cross-sectional side view illustrating a printer serving as an image forming apparatus according to a first embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, like reference numerals designate identical or corresponding parts throughout the several views.

First Embodiment

A printer 1 serving as an image forming apparatus having a front feed device 100 according to a first embodiment of the present invention is described with reference to FIG. 1. The printer 1, for example, employs an electrophotographic method and forms an image on a recording medium based on print data input. The feed device 100 according to the first embodiment of the present invention is described later with reference to FIG. 2.

Referring to FIG. 1, the printer 1 is illustrated in a cross-sectional side view. The printer 1 includes: a medium cassette 2 storing a sheet P serving as the recording medium; a pickup roller 3 picking up the sheet P sheet by sheet; a feed roller 4 conveying the sheet P supplied by the pickup roller 3; a retard roller 5 disposed pressed against the feed roller 4; a conveyance roller 6 conveying the sheet P; a driven roller 7 rotatably driven with rotation of the conveyance roller 6; a registration roller conveying the sheet P to an image forming unit 11; a pressure roller 9 disposed pressed against the registration roller 8; a print head 10 forming an electrostatic latent image on a photosensitive drum 12 by the light irradiated based on the print data input; the image forming unit 11 forming a toner image by adhesion of toner on the electrostatic latent image formed by the print head 10; a transfer roller 16 transferring the toner image formed by the image forming unit 11 to the sheet P; a heating roller 17 and a pressure roller 18 serving as a fixing unit fixing the toner image transferred on the sheet P with application of the heat and pressure; a conveyance roller 19 conveying the sheet P; a driven roller 20 rotatably driven with rotation of the conveyance roller 19; an ejection roller 21 ejecting the sheet P outside the printer 1; a driven roller 22 rotatably driven with rotation of the ejection roller 21; a front feed roller 23 feeding the sheet P from a front portion of the printer 1 to inside the printer 1; a separation member 24 disposed pressed against the front feed roller 23; a front cover member 31 disposed in the front portion of the printer 1 in an openable and closable manner; and a sheet conveyance path 32 serving as a substantially S-shaped path on which the sheet P is conveyed by rotation of each of the rollers.

The medium cassette 2 stores the sheet P or plural sheets P inside thereof in a state that the sheet P is or the plural sheets P are stacked therein. The medium cassette 2 is detachably attached in a lower portion of the printer 1. The pickup roller 3 is disposed above the medium cassette 2 so as to pick up the sheet P sheet by sheet.

The feed roller 4 is disposed on the side of a beginning edge of the sheet conveyance path 32. The retard roller 5 includes a torque limiter therein, and is disposed in such a manner as to press against the feed roller 4. Each of the retard roller 5 and the feed roller 4 is rotated by driving force supplied from a drive motor (not shown). The feed roller 4 and the retard roller 5 sandwich and convey the sheet P supplied from the pickup roller 3 in a sheet conveyance direction indicated by an arrow "d" shown in FIG. 1.

A pair of the conveyance roller 6 and the driven roller 7 and another pair of the registration roller 8 and the pressure roller 9 are disposed along the sheet conveyance path 32 between the feed roller 4 and the image forming unit 11. Such pairs of the rollers are rotated by the driving force supplied from the drive motor (not shown). Each of the pairs of the conveyance roller 6 and the driven roller 7 and the registration roller 8 and the pressure roller 9 sandwiches and conveys the sheet P supplied from the feed roller 4 to the image forming unit 11.

The print head 10 serves as a light emitting diode (LED) head having a lens array and a light emitting element such as LED, for example. The print head 10 irradiates a surface of the photosensitive drum 12 with the light based on the print data input, so that a potential of an irradiated area decays, thereby forming the electrostatic latent image.

The image forming unit 11 reversely develops the electrostatic latent image formed by the print head 10 with adhesion of the toner. Such an image forming unit 11 includes a charging roller 13 uniformly charging the surface of the photosensitive drum 12, a development roller 14 supplying the toner to the photosensitive drum 12, and a supply roller 15 supplying the toner to the development roller 14.

The photosensitive drum 12 includes a conductive support member and a photoconductive layer and serves as an organic photosensitive member. For example, a charge generation layer and a charge transportation layer serving as the photoconductive layers are sequentially laminated on a metal pipe, such as aluminum, serving as the conductive support member. The surface of the photosensitive drum 12 is uniformly charged by the charging roller 13 and forms the electrostatic latent image thereon by the light irradiated from the print head 10.

The charging roller 13 includes a metal shaft and a semi-conductive rubber layer made of, for example, epichlorohydrin rubber. The charging roller 13 is disposed in contact with the surface of the photosensitive drum 12 and is rotatably driven with rotation of the photosensitive drum 12. The charging roller 13 is connected with a charging roller power source (not shown) applying bias voltage of the same polarity as the toner, so that the surface of the photosensitive drum 12 is charged by the bias voltage applied from the charging roller power source.

The development roller 14 includes a metal shaft and a semi-conductive polyurethane rubber layer. The development roller 14 contacts the photosensitive drum 12 with a prescribed pressure contact amount therebetween and supplies the toner to the electrostatic latent image formed on the photosensitive drum 12, thereby reversely developing the electrostatic latent image. The development roller 14 is connected with a development roller power source (not shown) applying the bias voltage of the same polarity as the toner or opposite polarity of the toner, so that the charged toner is adhered to the electrostatic latent image on the photosensitive drum 12 by the bias voltage applied from the development roller power source, thereby developing the electrostatic latent image.

The supply roller 15 includes a metal shaft and a semi-conductive foam silicone sponge layer. The supply roller 15 contacts the development roller 14 with a prescribed pressure contact amount therebetween and supplies the toner to the development roller 14. The supply roller 15 is connected with a supply roller power source (not shown) applying the bias voltage of the same polarity as the toner or opposite polarity of the toner, thereby supplying the charged toner to the development roller 14 by the bias voltage applied from the supply roller power source.

The transfer roller 16 includes a metal shaft and a semi-conductive rubber layer made of, for example, epichlorohydrin rubber. The transfer roller 16 is disposed in contact with the surface of the photosensitive drum 12 and is rotatably driven with rotation of the photosensitive drum 12. The transfer roller 16 is connected with a transfer roller power source (not shown) applying the bias voltage of the opposite polarity of the toner, so that the toner image formed on the photosensitive drum 12 is transferred to the sheet P by the bias voltage applied from the transfer roller power source.

The pair of the heating roller 17 and the pressure roller 18 serves as the fixing unit fixing the toner image on the sheet P with application of the heat and pressure. Here, the heat roller 17 includes a core metal in a shape of cylindrical hollow, a heat resistant elastic layer made of silicone rubber, for example, and a PFA (tetrafluoroethylene-perfluoroalkyl vinyl ether copolymer) tube. The core metal made of aluminum, for example, is covered with the heat resistant elastic layer, and such a heat resistant elastic layer is covered with the PFA tube. The core metal includes a heater such as a halogen lamp therein. The pressure roller 18 includes a core metal made of aluminum, for example, a heat resistant elastic layer made of silicone rubber, for example, and a PFA tube. The core metal is covered with the heat resistant elastic layer, and such an elastic layer is covered with the PFA tube. The pressure roller 18 is disposed such that a pressure contact portion is formed between the pressure roller 18 and the heating roller 17. When the sheet P having the toner image transferred thereon by the transfer roller 16 passes through the pressure contact portion, the toner image is fixed by application of the heat and pressure.

A pair of the conveyance roller 19 and the driven roller 20 and another pair of the ejection roller 21 and the driven roller 22 are disposed on a downstream side of the fixing unit along the sheet conveyance path 32. The pair of the conveyance roller 19 and the driven roller 20 is rotated by driving force supplied from a drive motor (not shown), and sandwiches and conveys the sheet P passed through the fixing unit. The pair of the ejection roller 21 and the driven roller 22 is rotated by driving force supplied from the drive motor (not shown) and ejects the sheet P outside the printer 1.

The front feed roller 23 is disposed in a middle portion of the sheet conveyance path 32 between the feed roller 4 and the image forming unit 11, and conveys the sheet P stacked on the front cover member 31 also serving as a medium stacking unit in a direction "e" indicated by an arrow shown in FIG. 1, thereby feeding the sheet P inside the printer 1. The separation member 24 is, for example, made of high friction rubber, and contacts the front feed roller 23 with a prescribed pressure contact amount therebetween by pressure of a pressure member (not shown). The front cover member 31 is disposed in a storable manner on one side of an outside housing of the printer 1. For example, in a case where an image is formed on a long sheet or a thick sheet, the front cover member 31 is inclined. When the front cover member 31 is inclined, the front feed roller 23 is exposed, so that the sheet P is directly conveyed from the front cover member 31 to the image forming unit 11 inside the printer 1 with rotation of the front feed roller 23. The front feed roller 23 and a member in the vicinity thereof form the front feed device 100 serving as the feed device. A description of the front feed device 100 is given later.

The print 1 illustrated in FIG. 1 also includes: a print control unit (not shown) including a microprocessor, a read only memory (ROM), a random access memory (RAM), an input and output port, and a timer; an interface control unit (not shown) executing the print operation by receiving the print data and a control command and controlling a sequence of the printer 1 as a whole; a reception memory (not shown) temporarily storing the print data input through the interface control unit; an image data edition memory (not shown) receiving the print data stored in the reception memory and storing image data formed by editing the print data; a display unit (not shown) including a display device such as a liquid crystal display (LCD) to display a state of the printer 1; a manipulation unit (not shown) including an input mechanism such as a touch panel to receive an instruction from a user; a head drive control unit (not shown) transferring the image data stored in the image data edition memory and each of sensors, for example, a sheet position detection sensor, a temperature humidity sensor, and a density sensor, to the print head 10, and controlling the drive of the print head 10 to monitor an operation state of the printer 1; a temperature control unit (not shown) controlling the temperature of the fixing unit; a sheet conveyance motor control unit (not shown) controlling the drive motors driving respective rollers conveying the sheet P; a drive control unit (not shown) controlling the drive motor driving the photosensitive drum 12 to rotate; and the power sources (not shown) applying the voltage to respective rollers.

According to the printer 1, the image can be formed based on the print data input with respect to the sheet P stacked on the medium cassette 2 or the front cover member 31.

Figure 2:
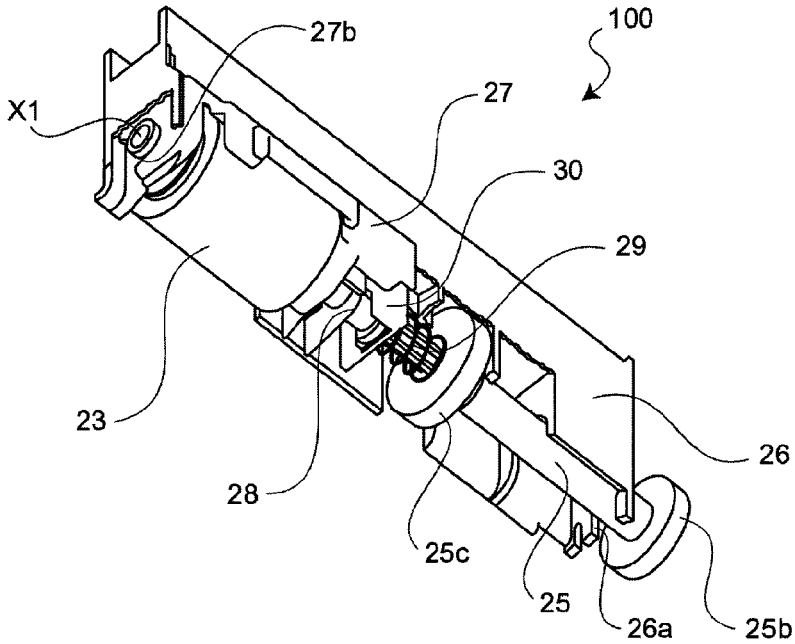
FIG. 2 is a schematic diagram illustrating a front feed device according to the first embodiment of the present invention.

Referring to FIG. 2, a description is given of the front feed device 100 serving as the feed device according to the first embodiment of the present invention.

The front feed device 100 includes the front feed roller 23, a drive shaft 25 transmitting driving force from a drive motor (not shown), a frame 26, a cover 27 serving as a cover member, a coupling member 28 serving as an engagement and disengagement member, a spring 29 disposed between the drive shaft 25 and the coupling member 28 to press both the drive shaft 25 and the coupling member 28, and a slide blade 30 in a cam shape forming a pair with the cover 27.

Figure 3A:
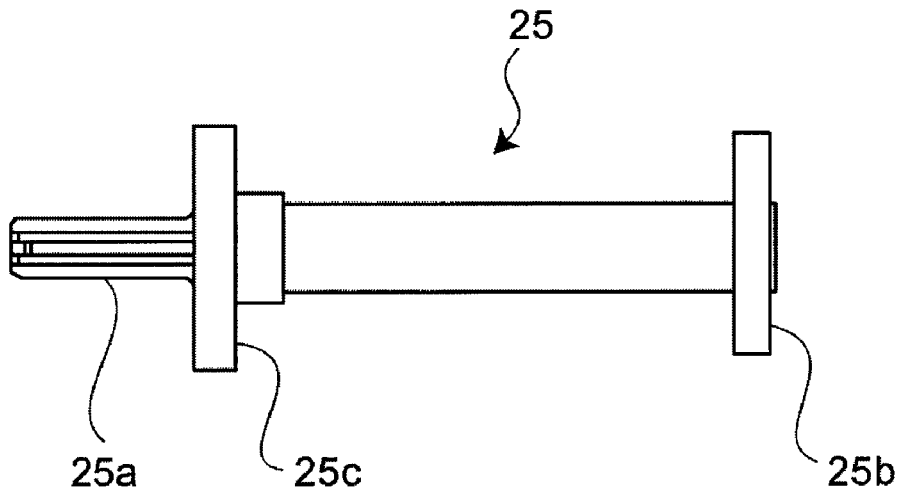
FIG. 3A is a front view illustrating a drive shaft included in the front feed device of FIG. 2.
Figure 3B:
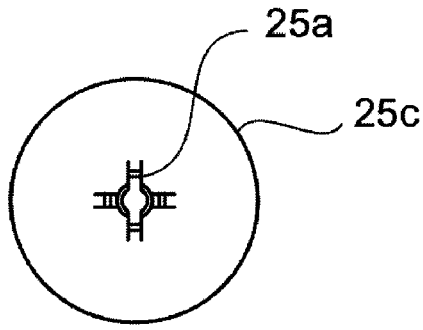
FIG. 3B is a side view illustrating the drive shaft.

The drive shaft 25 is molded from synthetic resin, for example, and serves as a circular cylindrical shaft member transmitting the driving force from the drive motor (not shown). A gear 25*b* engaging with a gear member of the drive motor (not shown) is disposed at one end of the drive shaft 25 in a longitudinal direction, and a stopper 25*c* latching the spring 29 is disposed at another end as illustrated in FIG. 3A. A protrusion channel portion 25*a* in a substantially cross shape as illustrated in FIG. 3B is disposed outside the stopper 25*c* to engage with an engagement hole 28*b* disposed on one side of the coupling member 28.

The frame 26 serves as an outside housing of the front feed device 100 and supports the cover 27 and the drive shaft 25. The frame 26 is molded from synthetic resin, for example.

The cover 27 is molded from synthetic resin, for example, and is attached in an openable and closable manner with respect to the frame 26. The cover 27 includes a cam 27*a* in a semilunar shape slidably contacting the slide blade 30, and allows the slide blade 30 to move in an axial direction of the drive shaft 25 according to opening and closing operation thereof. The cover 27 includes a bearing 27*b* supporting a one-end-side rotation shaft X1 of the front feed roller 23.

Figure 4A:
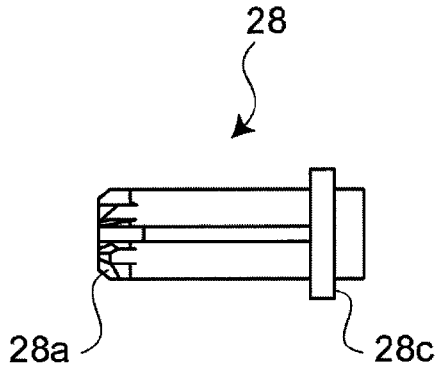
FIG. 4A is a front view illustrating a coupling member included in the front feed device of FIG. 2.
Figure 4B:
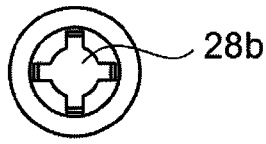
FIG. 4B is a side view illustrating the coupling member.
Figure 4C:
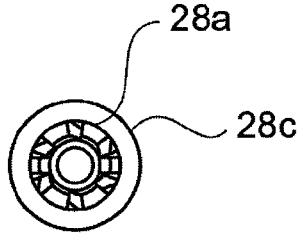
FIG. 4C is another side view illustrating the coupling member.
Figure 5:
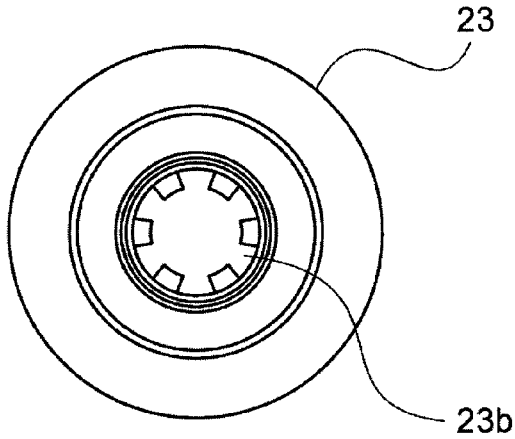
FIG. 5 is a side view illustrating a front feed roller included in the front feed device of FIG. 2.

The coupling member 28 is molded from synthetic resin, for example, and serves as the engagement and disengagement member engaging and disengaging the drive shaft 25 with the front feed roller 23. A stopper 28*c* latching the spring 29 is disposed on one end of the coupling member 28 in a longitudinal direction as illustrated in FIG. 4A. The engagement hole 28*b* engaging with the protrusion channel portion 25*a* of the drive shaft 25 is disposed outside the stopper 28*c* as illustrated in FIG. 4B. A plurality of protrusion channel portions 28*a*, each of which is in substantially hook shape, are disposed to another end of the coupling member 28 in the longitudinal direction as illustrated in FIG. 4C. The protrusion channel portions 28*a* can engage with the engagement hole 23*b* disposed on one side of the front feed roller 23 as illustrated in FIG. 5.

The spring 29 is made of a material such as SUS (i.e., stainless used steel standardized by Japanese Industrial Standards). The sprint 29 is disposed between the stopper 25*c* of the drive shaft 25 and the stopper 28*c* of the coupling member 28, and presses the stopper 25*c* and the stopper 28*c* with restoration force thereof.

Figure 6:
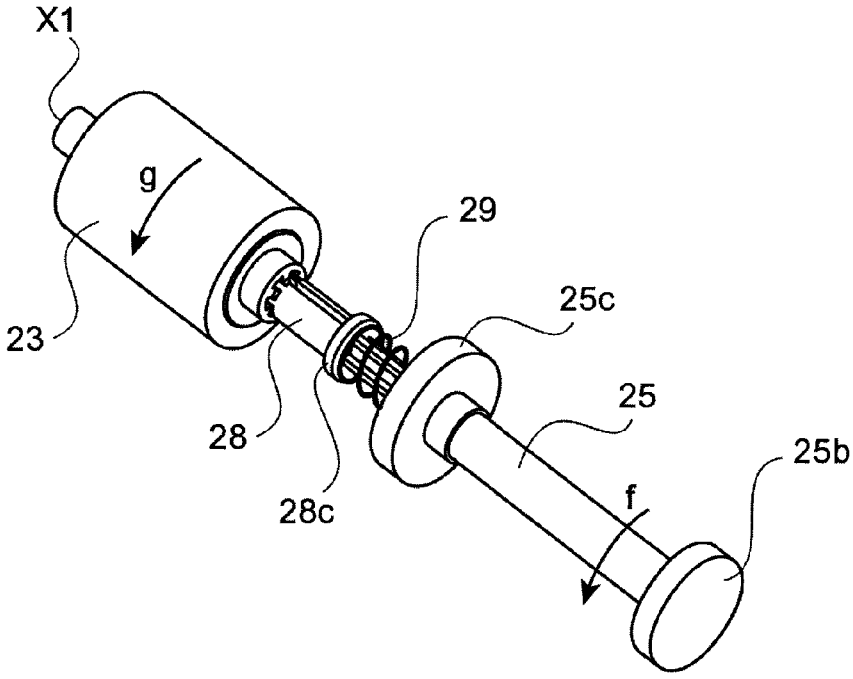
FIG. 6 is a schematic diagram illustrating connection of the front feed roller, the drive shaft and the coupling member.

The protrusion channel portion 28*a* of the coupling member 28 is inserted into the engagement hole 23*b* of the front feed roller 23, and the protrusion channel portion 25*a* of the drive shaft 25 is subsequently inserted to the engagement hole 28*b* of the coupling member 28 through the spring 29, thereby connecting the front feed roller 23, the drive shaft 25, and coupling member 28 as illustrated in FIG. 6. The drive shaft 25 connected is rotated in a direction "f" indicated by an arrow shown in FIG. 6 by the driving force transmitted through the gear 25*b*. The front feed roller 23 is rotated in a direction "g" indicated by an arrow shown in FIG. 6 with rotation of the drive shaft 25, thereby feeding the sheet P inside the printer 1.

Figure 7:
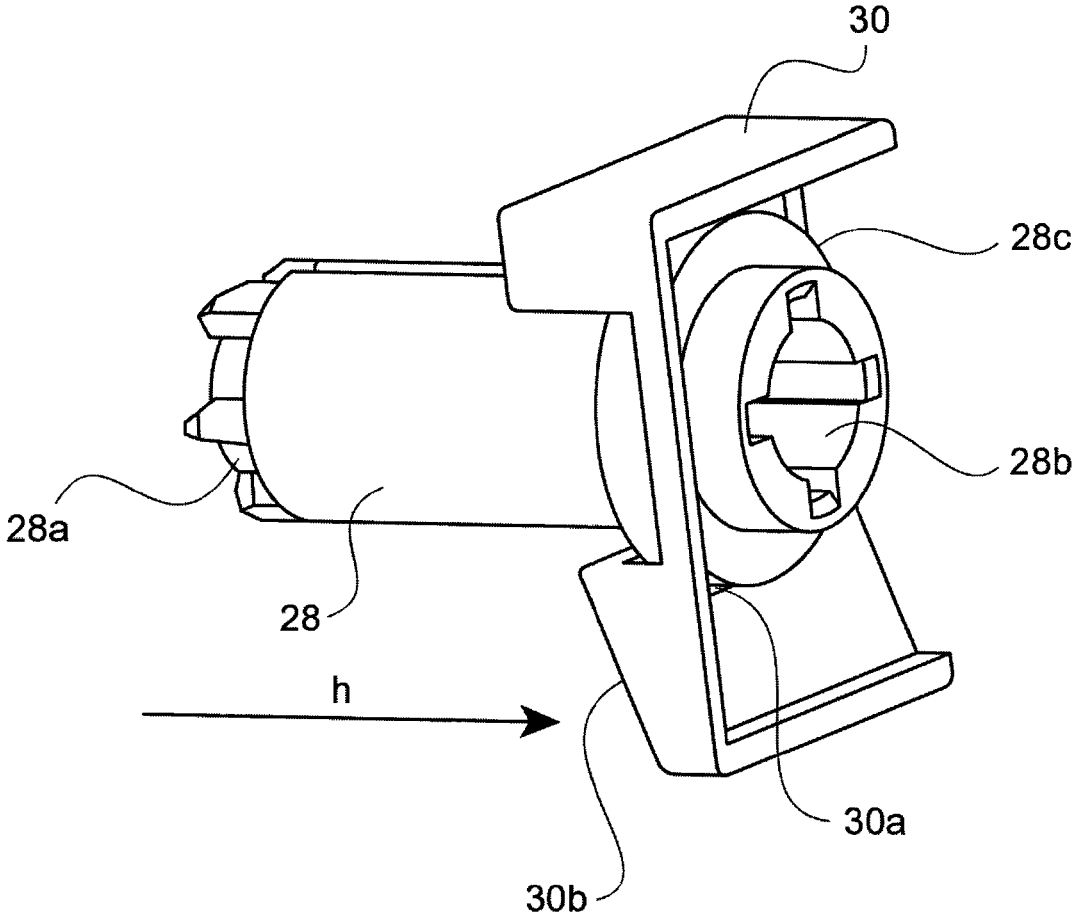
FIG. 7 is a schematic diagram illustrating a slide blade included in the front feed roller of FIG. 2.

The slide blade 30 is molded from synthetic resin, for example, and is attached by insertion into the coupling member 28 from a direction "h" indicated by an arrow shown in FIG. 7. A portion of the slide blade 30 includes a slide contact surface 30*b* slidably contacted with the cam 27*a* of the cover 27, and the slide blade 30 can move in the axial direction of the drive shaft 25 according to the opening and closing operation of the cover 27. The rotation of the slide blade 30 in a case of rotation of the coupling member 28 is stopped by joining a surface thereof with the frame 26. The stopper 28*c* of the coupling member 28 is engaged with an engagement groove 30*a* of the slide blade 30, allowing the coupling member 28 to move in the same direction as a movement direction of the slide blade 30.

The one-end-side rotation shaft X1 of the front feed roller 23 is supported by the bearing 27*b* disposed to the cover 27. The drive shaft 25, on the other hand, is supported by a bearing 26*a* disposed to the frame 26. Therefore, the front feed roller 23 and the drive shaft 25 engaged through the coupling member 28 can be secured to the frame 26.

Therefore, the front feed roller 23 can be replaced easily according to the front feed device 100 described above.

Now, the operation of the printer 1 including the front feed device 100 is described. The description of the print operation of the printer 1 is given and followed by the description of the operation relating to replacement of the front feed roller 23 deteriorated by the print operation over time.

The photosensitive drum 12 rotates at circumferential speed of a certain level by the drive control unit (not shown). The charging roller 13 disposed in contact with the surface of the photosensitive drum 12 applies direct current voltage supplied by the charging roller power source (not shown) to the surface of the photosensitive drum 12 while rotating, thereby uniformly charging the surface of the photosensitive drum 12. Subsequently, the print head 10 disposed opposite to the photosensitive drum 12 irradiates the uniformly charged surface of the photosensitive drum 12 with the light corresponding to the image data, so that the potential of the irradiated area decays, thereby forming the electrostatic latent image.

The development roller 14 is disposed in close contact with the photosensitive drum 12, and is applied with the voltage by the development roller power source (not shown). The development roller 14 absorbs the toner conveyed by the supply roller 15 and rotatably conveys such toner. In the course of rotatably conveying the toner, a development blade (not shown) disposed on a downstream side of the supply roller 15 presses against the development roller 14 and forms a development layer having uniform thickness with the toner absorbed to the development roller 14.

The development roller 14 reversely develops the electrostatic latent image formed on the photosensitive drum 12 with the toner being carried. Since the bias voltage is applied between the conductive support member of the photosensitive drum 12 and the development roller 14 by the high voltage power source, an electric line of force involving the electrostatic latent image formed on the photosensitive drum 12 is generated between the development roller 14 and the photosensitive drum 12. The charged toner on the development roller 14 is adhered to an electrostatic latent image portion on the photosensitive drum 12 by the electrostatic force, and the electrostatic latent image portion is developed, thereby forming the toner image. Such a development process begins with the beginning of the rotation of the photosensitive drum 12 at a prescribed timing.

The pickup roller 3 picks up the sheet P stacked on the medium cassette 2 sheet by sheet. The sheet P picked up by the pickup roller 3 is conveyed sheet by sheet in the direction "d" indicated by the arrow shown in FIG. 1 by the feed roller 4 and the retard roller 5. Subsequently, the pair of the registration roller 8 and the pressure roller 9 conveys the sheet P to the image forming unit 11 while correcting the sheet P on the skew. The front feed roller 32 and the separation member 24 sandwich and convey the sheet P stacked on the front cover member 31 in the direction "e" indicated by the arrow shown in FIG. 1, so that the sheet P is conveyed to the image forming unit 11. Such a development process described above begins at a prescribed timing within a time at which the sheet P is conveyed to the image forming unit 11.

The transfer roller 16 is disposed opposite to the photosensitive drum 12 of the image forming unit 11 in a pressure contact state and is applied with the voltage by the transfer roller power source (not shown), so that a transfer process transferring the toner image formed on the photosensitive drum 12 to the sheet P is performed.

The sheet P having the toner image transferred thereon is conveyed to the fixing unit having the heating roller 17 and the pressure roller 18. The heating roller 17 melts the toner on the sheet P with the heat, and the toner image on the sheet P is fixed by application of the pressure in the pressure contact portion between the heating roller 17 and the pressure roller 18.

The sheet P having the developer image fixed thereon is further conveyed by the pair of the conveyance roller 19 and the driven roller 20, and is ejected outside the printer 1 by the pair of the ejection roller 21 and the driven roller 22.

Therefore, the printer 1 can form the image on the sheet P based on the print data by cooperation of each of the rollers.

Now, the replacement operation of the front feed roller 23 deteriorated by the print operation over time is described.

Figure 8:
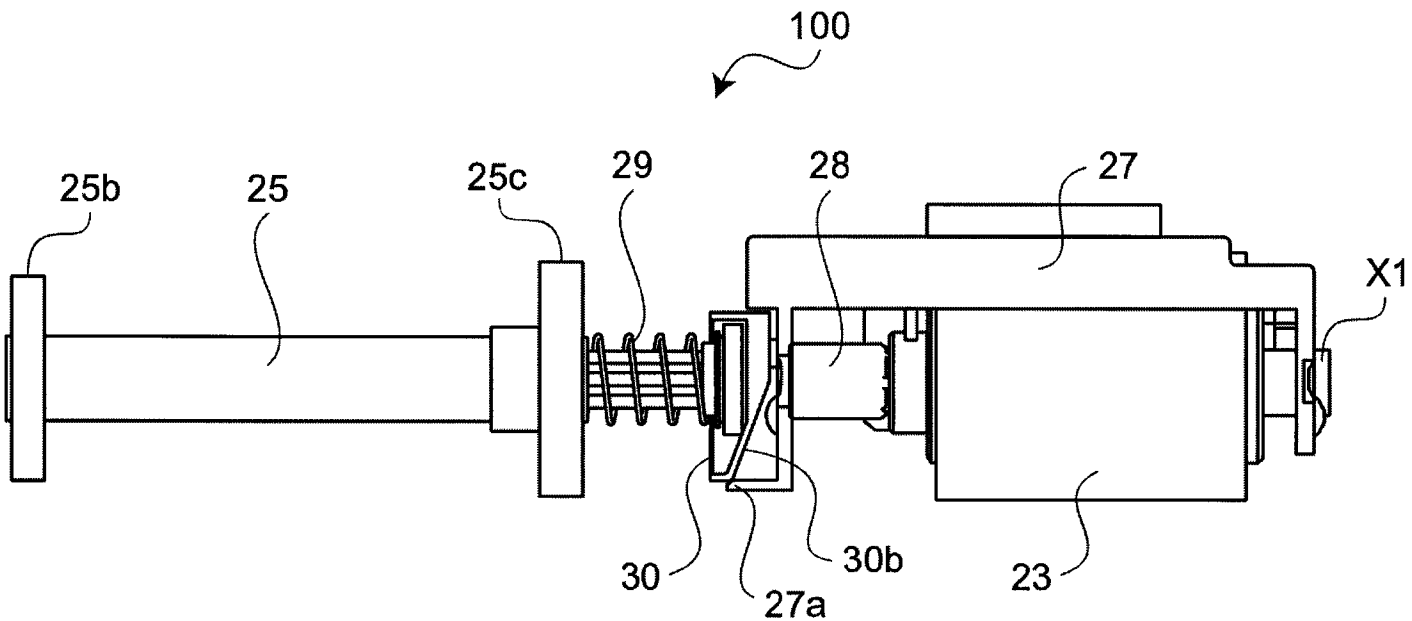
FIG. 8 is a back view illustrating the front feed device.

Referring to FIG. 8, the cover 27 of the front feed device 100 in a closed state is illustrated in a back view. Since the protrusion channel portion 28*a* of the coupling member 28 is engaged with the engagement hole 23*c* of the front feed roller 23 in a state that the cover 27 is closed, the rotation of the drive shaft 25 is transmitted to the front feed roller 23 through the coupling member 28.

Figure 9:
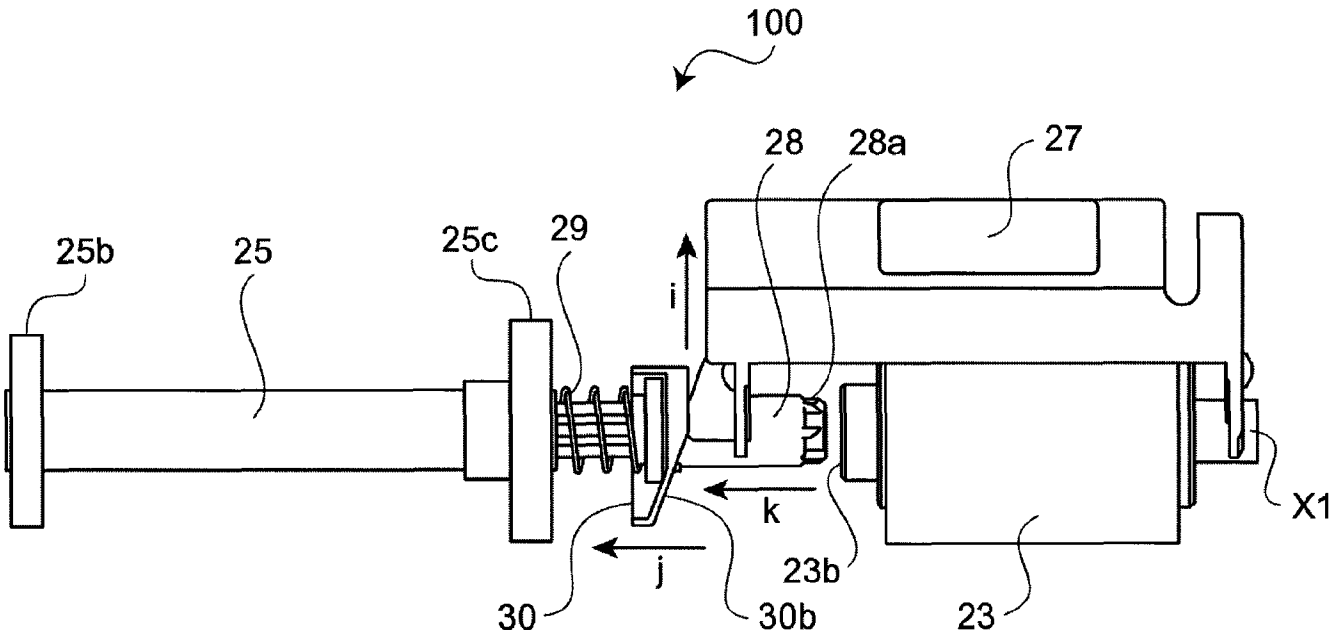
FIG. 9 is another back view illustrating the front feed device.
Figure 10:
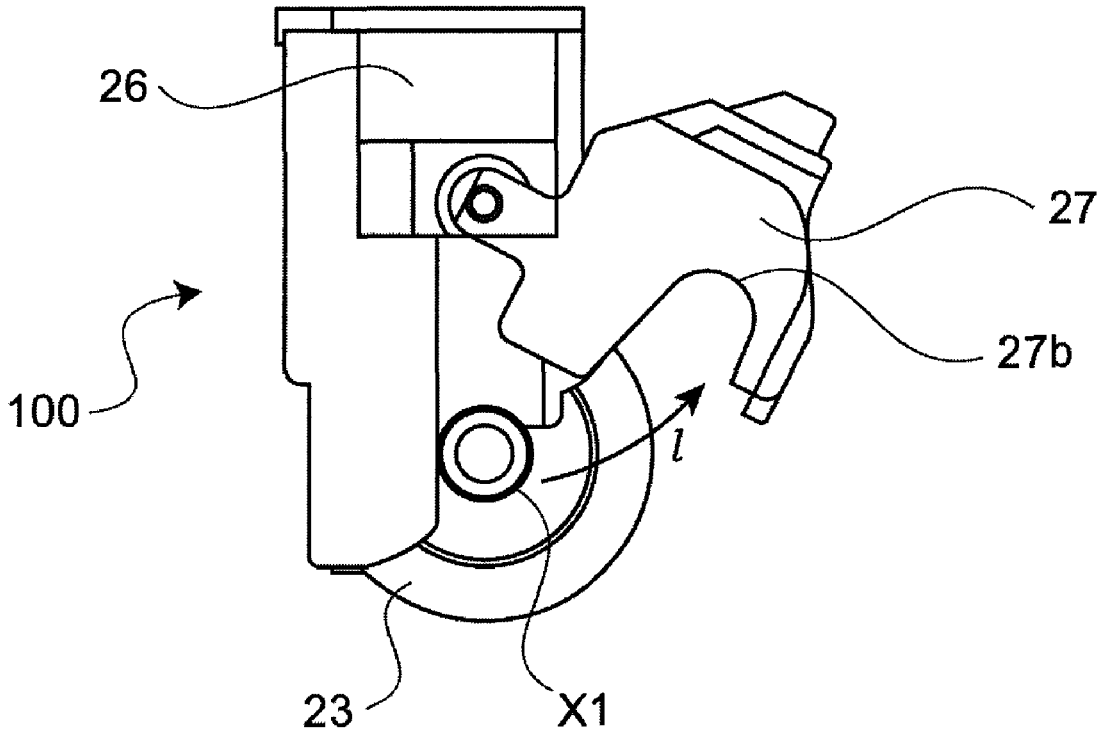
FIG. 10 is a side view illustrating the front feed device.

Herein, in a case where the cover 27 is open in a direction "i" indicated by an arrow shown in FIG. 9, the cam 27*a* disposed to the cover 27 slidably contacts the slide contact surface 30*b*, and pushes the slide blade 30 in a direction "j" indicated by an arrow shown in FIG. 9. The coupling member 28 moves in the same direction as the slide blade 30, that is, a direction "k" indicated by an arrow shown in FIG. 9, with movement of the slide blade 30. Consequently, the protrusion channel portion 28*a* of the coupling member 28 and the engagement hole 23*b* of the front feed roller 23 are disengaged. Moreover, in a case where the cover 27 is open in a direction "l" indicated by an arrow shown in FIG. 10, the one-end-side rotation shaft X1 of the front feed roller 23 and the bearing 27*b* of the cover 27 are disengaged, thereby allowing the front feed roller 23 to be detached from the front feed device 100.

In a case where the front feed roller 23 is attached to the front feed device 100, on the other hand, the front feed roller 23 is stored in an original position, so that front feed roller 23 is attached by closing the cover 27. That is, in a case where the cover 27 is closed in a direction opposite to the direction "i" indicated by the arrow shown in FIG. 9, the cam 27*a* disposed to the cover 27 slidably contacts the slide contact surface 30*b* of the slide blade 30, so that the cover 27 is returned to the original position as illustrated in FIG. 8. Here, the slide blade 30 moves in the direction opposite to the direction "i" indicated by the arrow shown in FIG. 9 by the restoration force of the spring 29. The coupling member 28 moves in the direction opposite to the direction "k" indicated by the arrow shown in FIG. 9 with movement of the slide blade 30. Consequently, the protrusion channel portion 28*a* of the coupling member 28 engages with the engagement hole 23*b* of the front feed roller 23. Moreover, in a case where the cover 27 is closed in the direction opposite to the direction "1" indicated by the arrow shown in FIG. 10, the one-end-side rotation shaft X1 of the front feed roller 23 and the bearing 27*b* of the cover 27 are engaged, thereby allowing the front feed roller 23 to be attached to the front feed device 100.

In a case where the front feed roller 23 is attached to the front feed device 100, the protrusion channel portion 28*a* of the coupling member 28 and the engagement hole 23*b* of the front feed roller 23 can be engaged by shifting a phase of the coupling member 28 by rotation of the drive shaft 25 even when the protrusion channel portion 28*a* of the coupling member 28 does not suitably engage with the engagement hole 23*b* of the front feed roller 23.

According to the first embodiment described above, the cam 27*a* serving as a cam mechanism is disposed to the cover 27, so that front feed roller 23 is easily engaged and disengaged by the opening and closing operation of the cover 27. In a prior art front feed device employing a snap-fit method, a bearing of a front feed roller needs to change a shape thereof so as to be pushed. According to the first embodiment, on the other hand, the coupling member 28 having a coupling mechanism is used to engage the front feed roller 23 with the drive shaft 25, thereby allowing the engagement of the front feed roller 23 and the drive shaft 25 without applying the excess load to the bearing.

Second Embodiment

According to the first embodiment described above, the printer 1 includes the front feed device 100 allowing the front feed roller 23 to be easily engaged and disengaged by the opening and closing operation of the cover 27 with the cam mechanism disposed to the cover 27. According to a second embodiment of the present invention, a cover can be secured in a prescribed position to enhance the convenience of replacing a front feed roller by a user in a case where the cover is open.

A printer 2001 and a front feed device 200 according to the second embodiment are substantially similar to the printer 1 and the front feed device 100 described above in the first embodiment. The print operation and the operation of replacing a front feed roller according to the second embodiment are substantially similar to those according to the first embodiment. Components of the printer 2001 and the front feed device 200 that differ from those of the above embodiment will be described, and like components will be given the same reference numerals as above and description thereof will be omitted for the sake of simplicity.

Figure 11A:
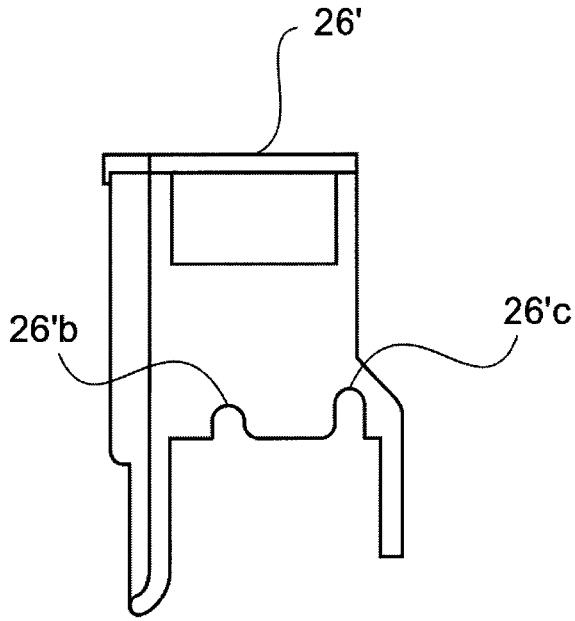
FIG. 11A is a side view illustrating a front feed device according a second embodiment of the present invention.
Figure 11B:
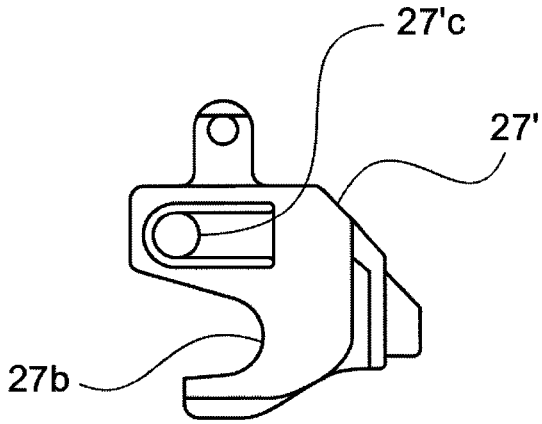
FIG. 11B is another side view illustrating the front feed device according the second embodiment of the present invention.

Referring to FIGS. 11A and 11B, the front feed device 200 according to the second embodiment is illustrated. The front feed device 200 includes a frame 26' having engagement grooves 26'*b* and 26'*c* and a cover 27' having a protrusion portion 27'C.

The frame 26', for example, molded from synthetic resin, serves as an outside housing of the front feed device 200 and supports the cover 27' and a drive shaft 25. The frame 26' includes the engagement grooves 26'*b* and 26'*c* capable of engaging with the protrusion portion 27'*c* included in the cover 27'.

The cover 27 is molded from synthetic resin, for example, and is attached in an openable and closable manner with respect to the frame 26'. The cover 27' includes a cam 27*a* in a semilunar shape slidably contacting a slide blade 30, and the slide blade 30 can move in an axial direction of the drive shaft 25 according to the opening and closing operation of the cover 27'. The cover 27' includes a bearing 27*b* supporting a one-end-side rotation shaft X1 of a front feed roller 23. The cover 27' includes the protrusion portion 27'*c* capable of engaging with the engagement grooves 26'*b* and 26'*c* of the frame 26'.

Referring now to FIGS. 12A, 12B, 13A, 13B, 14A, and 14B, operation of replacing the front feed roller 23 of the front feed device 200 is illustrated.

Figure 12A:
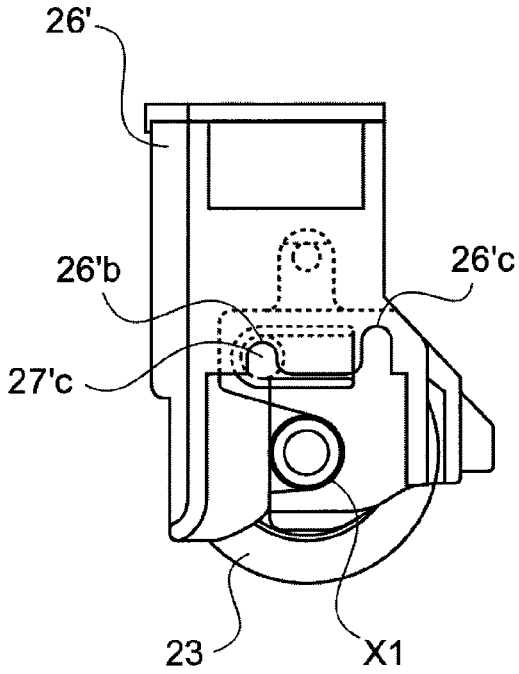
FIG. 12A is a side view illustrating the front feed device according to the second embodiment.
Figure 12B:
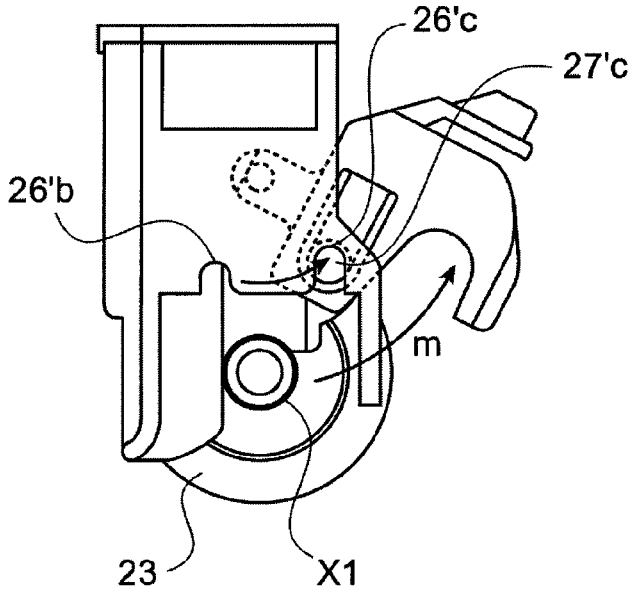
FIG. 12B is another side view illustrating the front feed device according to the second embodiment.

FIG. 12A illustrates the front feed device 200 in a side view in a state that the cover 27' is closed. Herein, the protrusion portion 27'*c* of the cover 27' is engaged with the engagement groove 26'*b* of the frame 26', so that the cover 27' is locked into the frame 26'. On the other hand, in a case where the cover 27' is open in a direction "m" indicated by an arrow shown in FIG. 12B, the protrusion portion 27' of the cover 27' is engaged with the engagement groove 26'*c* of the frame 26', so that the cover 27' is locked into the frame 26' in a state that the cover 27' remains open.

Figure 13A:
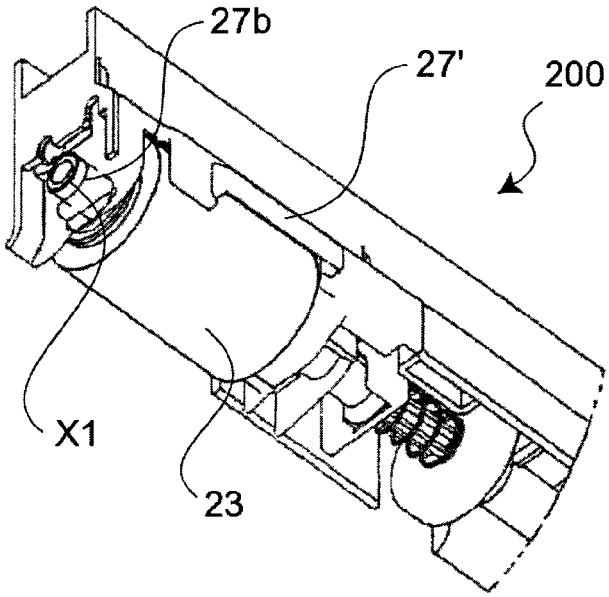
FIG. 13A is a schematic diagram illustrating the front feed device according to the second embodiment.
Figure 13B:
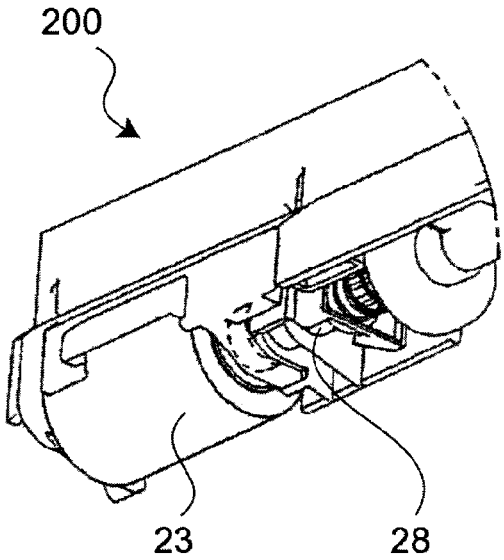
FIG. 13B is another schematic diagram illustrating the front feed device according to the second embodiment.

FIGS. 13A and FIG. 13B illustrate the front feed device 200 in schematic diagrams in a state that the cover 27' is closed. Herein, the one-end-side rotation shaft X1 of the front feed roller 23 is engaged with the bearing 27*b* of the cover 27' as illustrated in FIG. 13A. Herein, the protrusion channel portion 28*a* of the coupling member 28 is being engaged with an engagement hole 23*b* of the front feed roller 23 as illustrated in FIG. 13B.

Figure 14A:
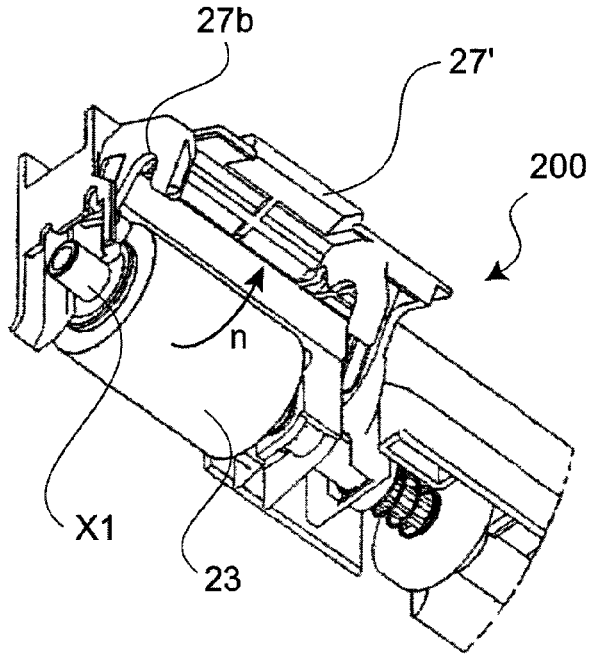
FIG. 14A is a schematic diagram illustrating the front feed device according to the second embodiment.
Figure 14B:
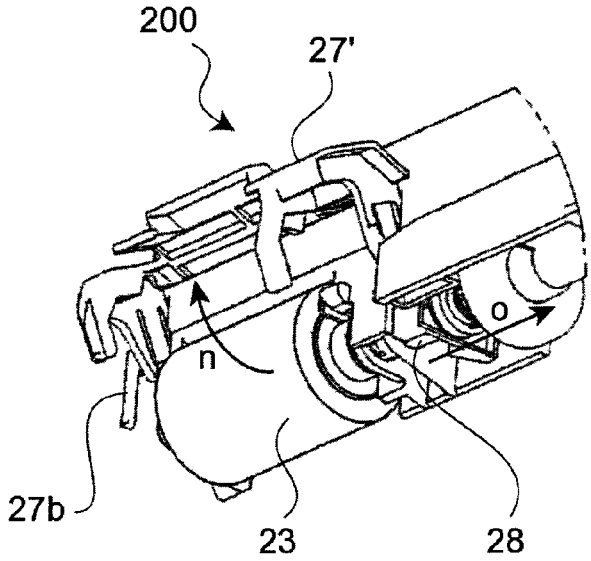
FIG. 14B is another schematic diagram illustrating the front feed device according to the second embodiment.

Each of FIGS. 14A and 14B illustrates the front feed device 200 in a schematic diagram in a state that the cover 27' is open in a direction "n" indicated by an arrow. Herein, the one-end-side rotation shaft X1 of the front feed roller 23 is disengaged with the bearing 27*b* of the cover 27' as illustrated in FIG. 14A. Here, the coupling member 28 moves in a direction "o" indicated by an arrow shown in FIG. 14*b*, so that the protrusion channel portion 28*a* of the coupling member 28 and the engagement hole 23*b* of the front feed roller 23 are disengaged each other. The protrusion portion 27' of the cover 27' is engaged with the engagement groove 26'. Consequently, the cover 27' is locked into the frame 26' in a state that the cover 27' is being open.

In addition to the advantage of the first embodiment, since the cover 27' remains open according to the second embodiment, the user can easily replace the front feed roller 23. Moreover, in a case where the cover 27' is closed, the cover 27' is locked, thereby reducing an occurrence of improperly opening thereof according to the second embodiment.

Third Embodiment

According to the second embodiment described above, in a case where the cover 27'*c* is open, the cover 27'*c* can be secured in a prescribed position to enhance user convenience of the replacing the front feed roller 23. According to a third embodiment, on the other hand, a cover can be closed simultaneously with the closure of a front cover member.

A printer 3001 and a front feed device 300 according to the third embodiment are substantially similar to the printer 1 and the front feed device 100 described above in the first embodiments and to the printers 2001 and the front feed devices 200 described above in the second embodiments. The print operation and the operation of replacing a front feed roller according to the third embodiment are substantially similar to those according to the first and second embodiments. Components of the printer 3001 and the front feed device 300 that differ from those of the above embodiments will be described, and like components will be given the same reference numerals as above and description thereof will be omitted for the sake of simplicity.

Figure 15:
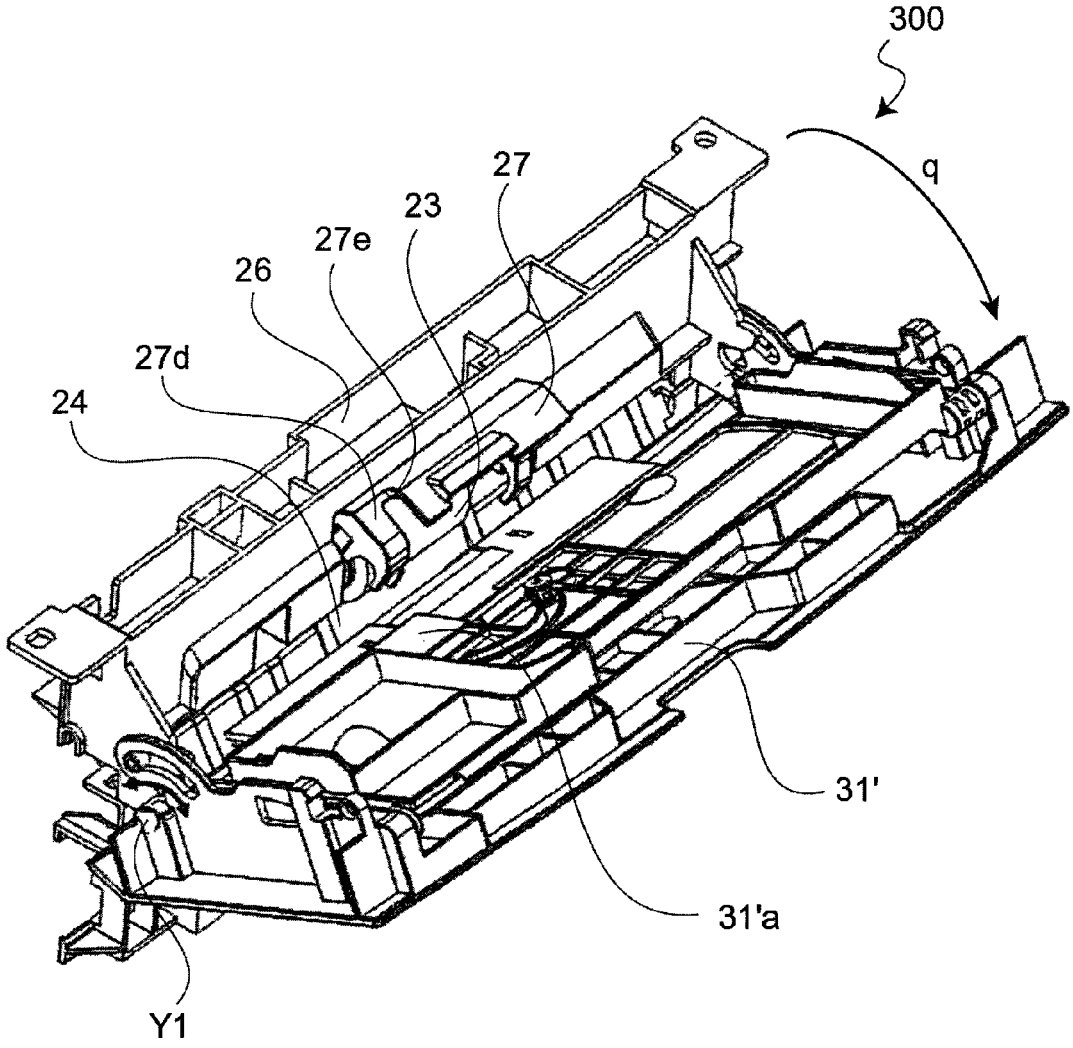
FIG. 15 is a schematic diagram illustrating a front feed device according to a third embodiment.

Referring to FIG. 15, the front feed device 300 according to the third embodiment is illustrated. The front feed device 300 includes a plate member 31'*a* integrally provided with a front cover member 31'. FIG. 15 illustrates the front feed device 300 in a schematic diagram in a state that the front cover member 31' is inclined toward a direction "q" indicated by an arrow with respect to a shaft Y1 serving as a rotation shaft.

Figure 16:
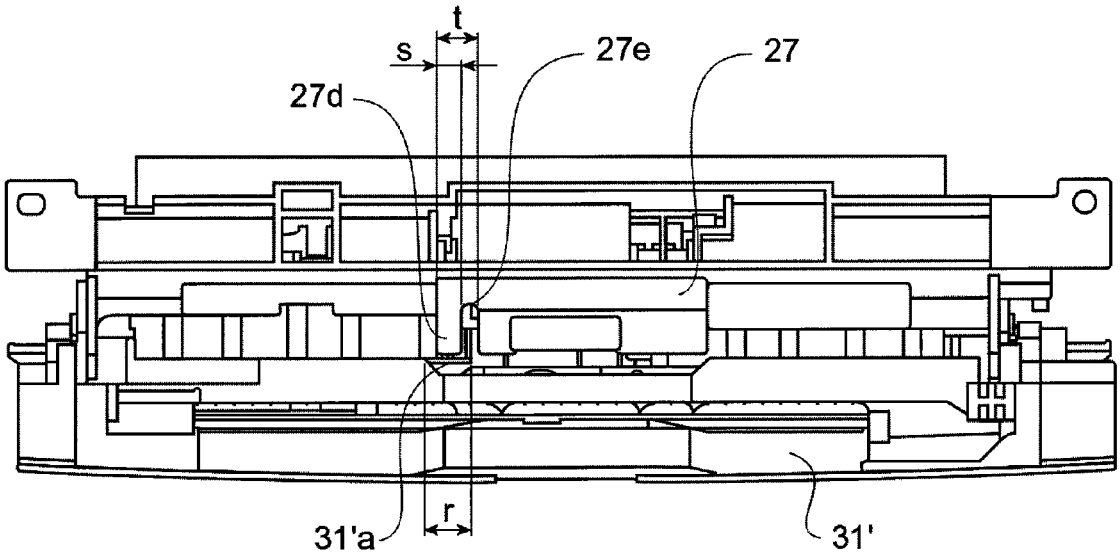
FIG. 16 is a front view illustrating the front feed device according to the third embodiment.

The plate member 31'*a* is molded from synthetic resin, for example, and serves as a rectangular plate member disposed in a position face to face with an end portion 27*d* of a cover 27. The plate member 31'*a* and the end portion 27*d* of the cover 27 have lengths of "r," and "s," respectively in a short direction. As illustrated in FIG. 16, the length "r" of the plate member 31'*a* is longer than the length "s" of the end portion 27*d* of the cover 27, and is shorter than a sum length "t" of the length "s" and a length of a groove 27*e* in the short direction (i.e., $s \leqq r \leqq t$). Moreover, the end portion 27*d* of the cover 27 is disposed with a certain curvature thereof in such a manner as to slidably contact on the plate member 31.

Figure 17A:
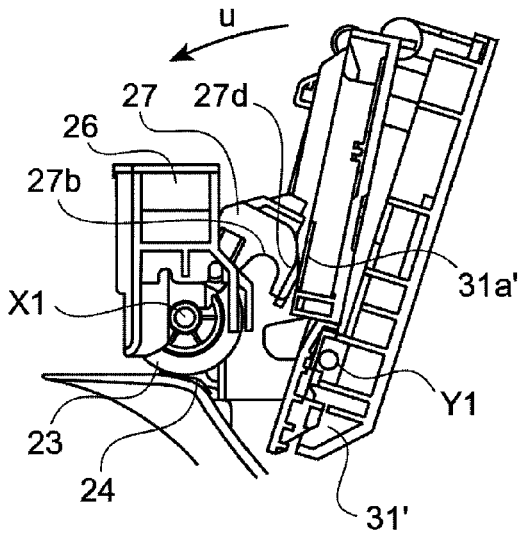
FIG. 17A is a side view illustrating the front feed device according to the third embodiment.
Figure 17B:
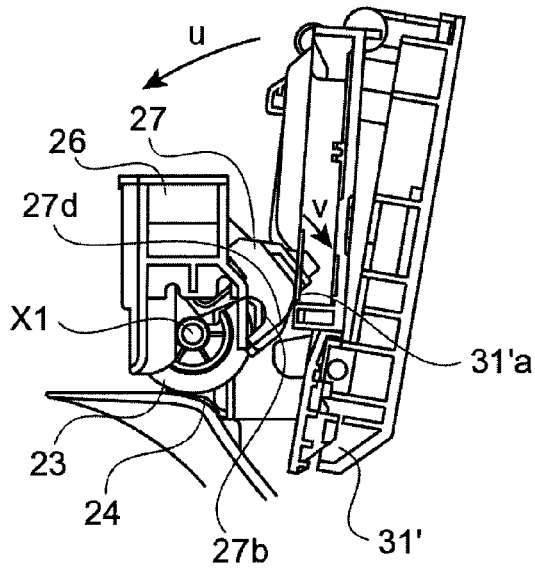
FIG. 17B is another side view illustrating the front feed device according to the third embodiment.
Figure 17C:
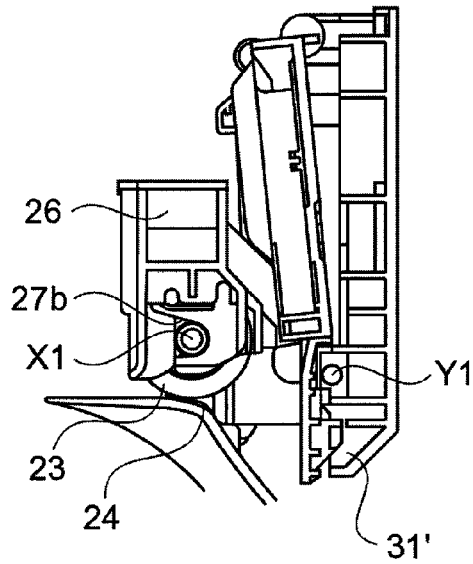
FIG. 17C is yet another side view illustrating the front feed device according to the third embodiment.

Referring to FIGS. 17A, 17B and 17C, the operation of closing the front cover member 31 is illustrated in side views. In a case where the front cover member 31' is closed in a direction "u" indicated by arrow shown in FIG. 17A, the end portion 27*d* of the cover 27 contacts the plate member 31'*a* of the front cover member 31'. The front feed roller 23 is applied with the pressure in an upward direction from a separation member 24 contacting thereto with a certain pressure and is sandwiched between the separation member 24 and the frame 26, thereby being tentatively secured.

In a case where the front cover member 31' is further pushed in the direction "u" indicated by the arrow shown in FIG. 17B, the end portion 27*d* of the cover 27 slidably contacts on the plate member 31'*a* of the front cover member 31' in a direction "v" indicated by an arrow shown in FIG. 17B, and the cover 27 rotates in the direction "v."

In a case where the front cover member 31' is closed completely, a one-end-side rotation shaft X1 of the front feed roller 23 is engaged by a bearing 27*b* of the cover 27, thereby being completely locked as illustrated in FIG. 17C.

According to the third embodiment, the front cover member 31' is disposed to the plate member 31'*a*, and the end portion 27*d* of the cover 27 is disposed with the certain curvature, so that the front feed roller 23 not only is secured but also the cover 27 is closed by setting the front feed roller 23 and pushing the front cover member 31'. Therefore, in addition to advantages of the first and second embodiments, the front feed roller 23 can be replaced more efficiently according to the third embodiment.

Fourth Embodiment

Figure 35:
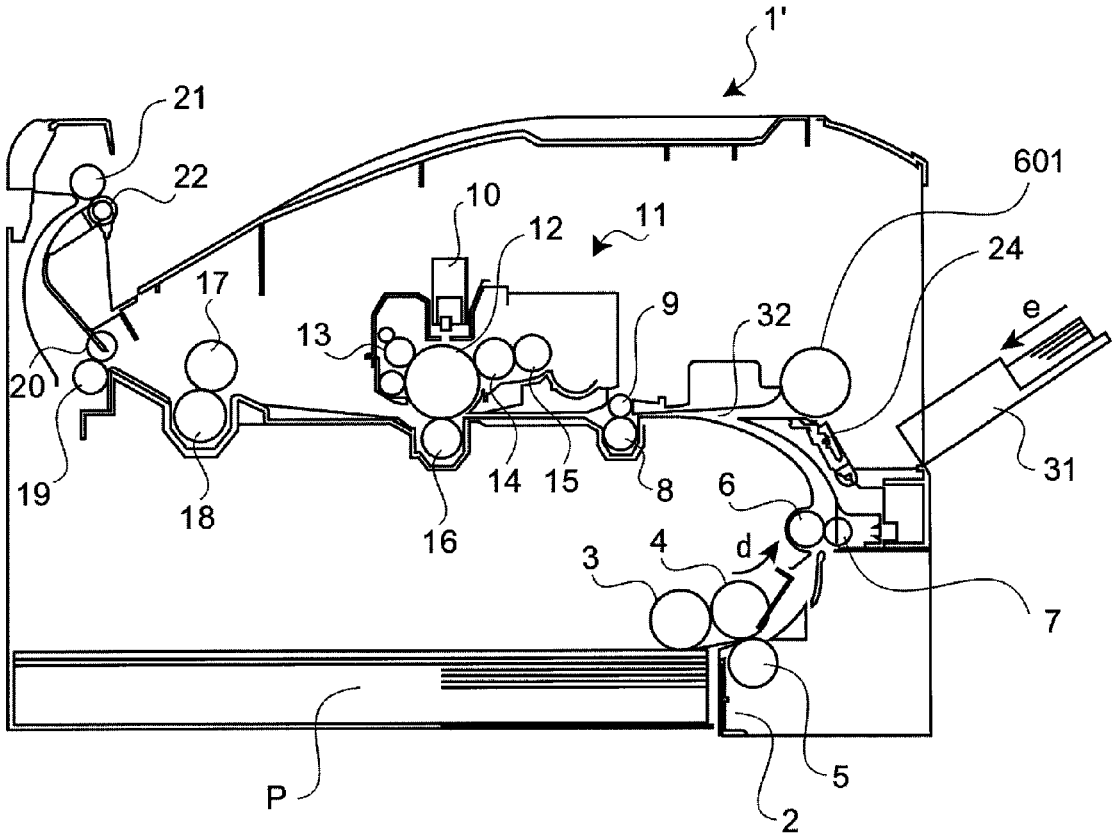
FIG. 35 is a schematic diagram illustrating an image forming apparatus according the fourth embodiment of the present invention.

Referring to FIG. 35, a printer 1' according to a fourth embodiment of the present invention is illustrated in a schematic diagram. The printer 1' and print operation according to the fourth embodiment are substantially similar to the printers and the print operation of the first, second, and third embodiments. Components of the printer 1' and the print operation that differ from those of the above embodiments will be described, and like components will be given the same reference numerals as above and description thereof will be omitted for the sake of simplicity.

Figure 18:
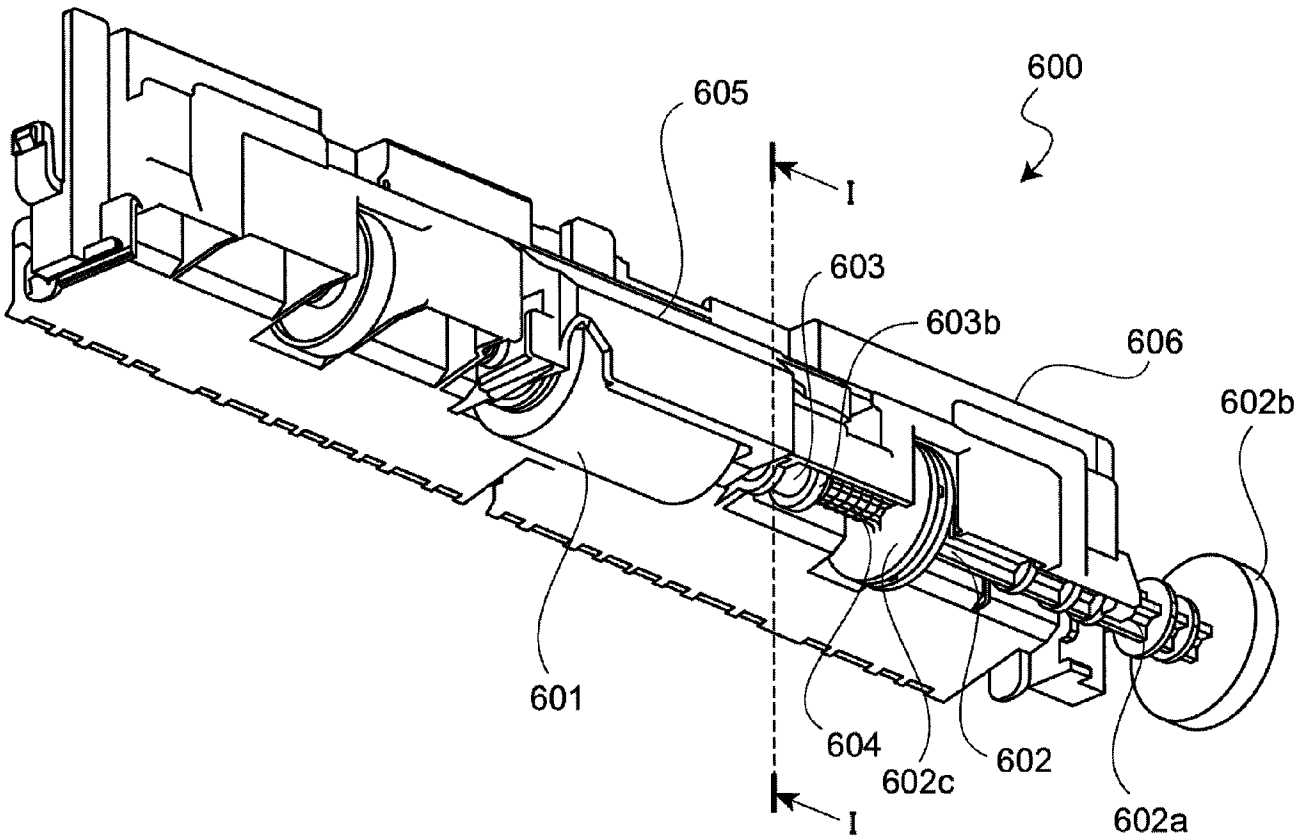
FIG. 18 is a schematic diagram illustrating a front feed device according to a fourth embodiment.

Referring to FIG. 18, a front feed device 600 including a front feed roller 601 according to the fourth embodiment is illustrated in a schematic diagram.

The front feed device 600 includes the front feed roller 601, a drive shaft 602 supported by a frame 606 in such a manner as to be rotatable, a coupling member 603 serving as an engagement and disengagement member, a spring 604 disposed between the drive shaft 602 and the coupling member 603, and a cover 605 being openable and closable with respect to the frame 606.

Figure 19A:
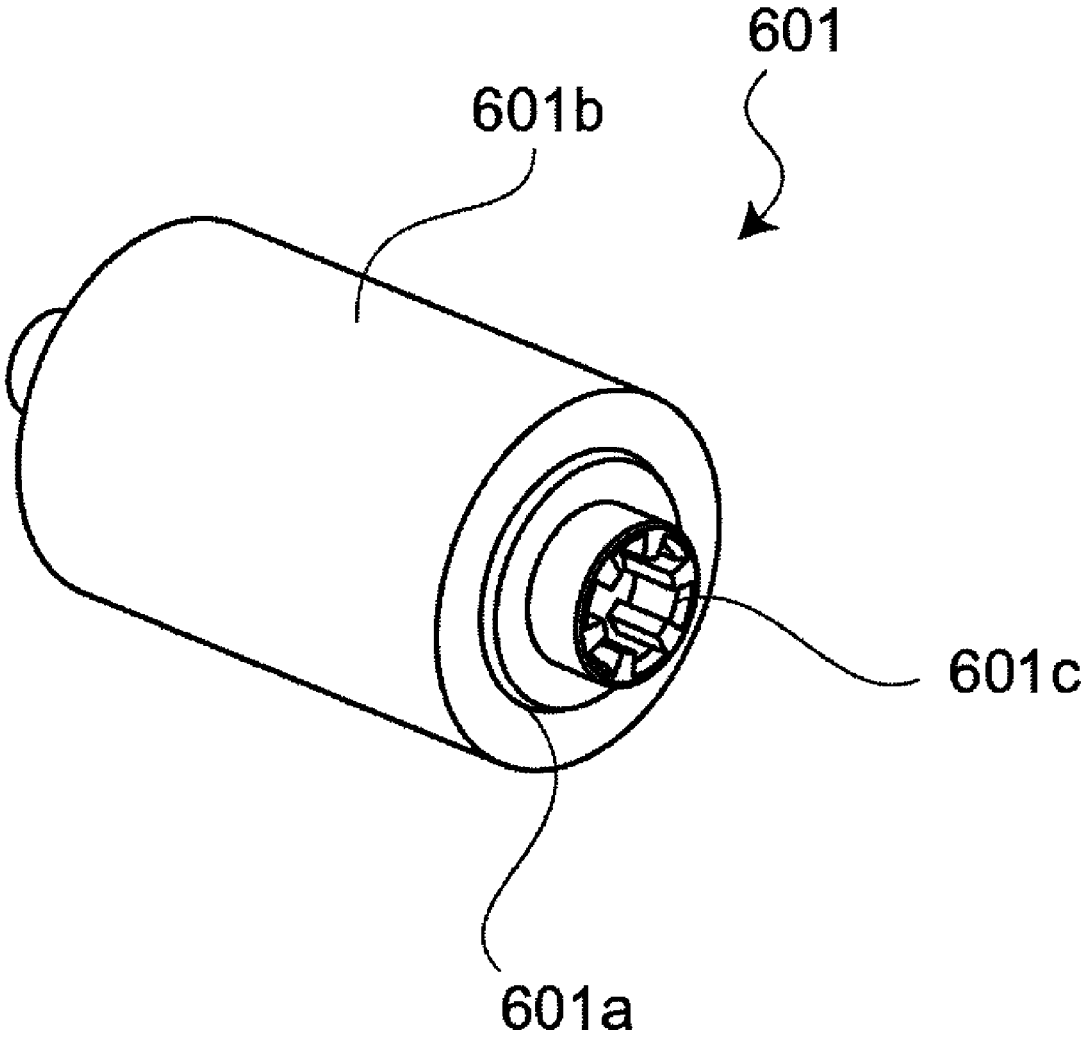
FIG. 19A is a schematic diagram illustrating a front roller included in the front feed device of FIG. 18.
Figure 19B:
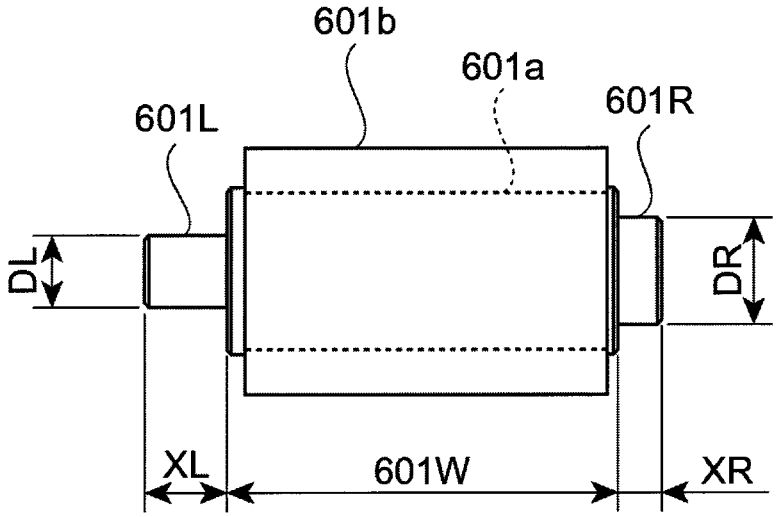
FIG. 19B is a front view illustrating the front roller of FIG. 19A.
Figure 19C:
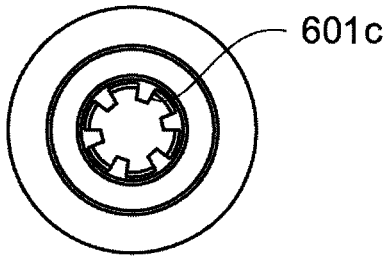
FIG. 19C is a side view illustrating the front roller of FIG. 19A.

Referring to FIGS. 19A, 19B, and 19C, the front feed roller 601 is illustrated. The front feed roller 601 includes a boss 601*a* serving as a support shaft, a rubber roller 601*b* would around the boss 601*a*, and a coupling portion 601*c* as illustrated in FIG. 19A. The boss 601*a* serving as the support shaft has a length of "601W" in a longitudinal direction, and a shaft member 601L and a shaft member 601R are disposed at each end of the boss 601*a* as illustrated in FIG. 19B. The shaft members 601L and 601R are rotatably supported with respect to the cover 605 and the frame 606. The shaft member 601L has an outside diameter of "DL" and a length of "XL," and the shaft member 601R has an outside diameter of "DR" and a length of "XR." Each of the outside diameters of "DL" and "DR" and the lengths of "XL" and "XR" is arranged in such a manner as to be different from one another. In this way, a likelihood of an error occurrence between the right and left of the front feed roller 601 can be reduced in a case where the front feed roller 601 is attached by the user. The shaft member 601R includes a coupling portion 601*c* having concavity and convexity inside thereof as illustrated in FIG. 19C. The shaft member 601R is connected to the coupling member 603, so that driving force is transmitted through the drive shaft 602.

Figure 20A:
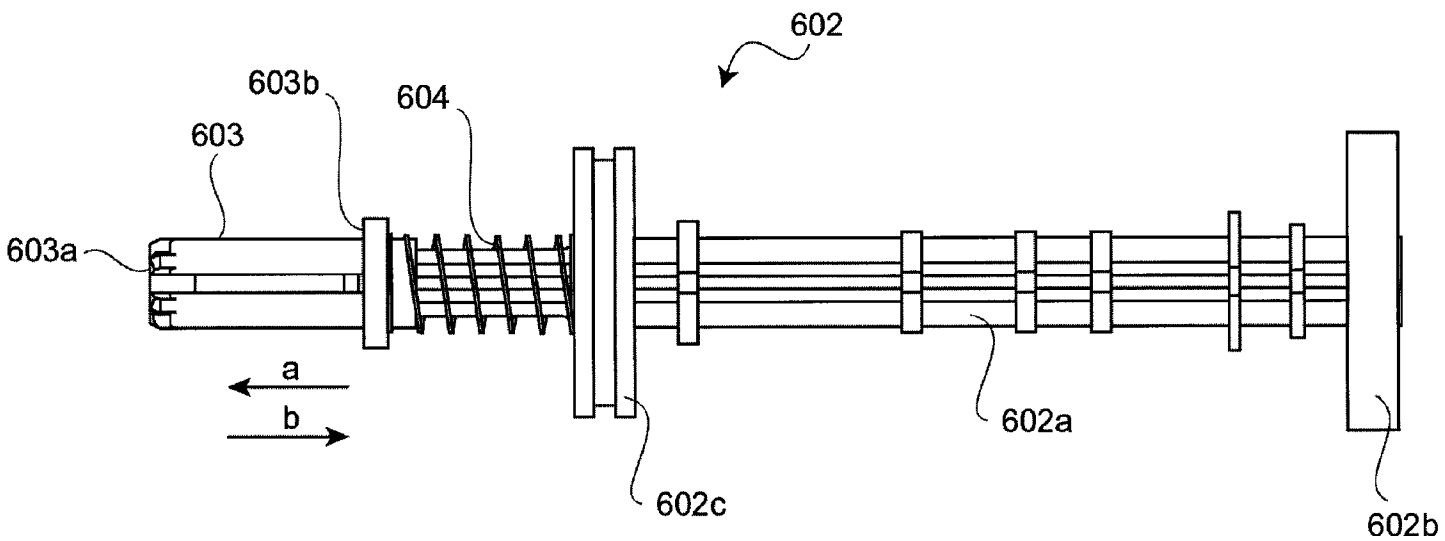
FIG. 20A is a front view illustrating a drive shaft of the front feed device according to the fourth embodiment.

The drive shaft 602 is molded from synthetic resin, for example, and includes a shaft member 602*a* in a substantially circular shape transmitting driving force from a drive motor (not shown). The shaft member 602*a* includes a gear 602*b* engaging with a gear included in the driving motor (not shown) at one end thereof and a stopper 602*c* latching a spring 604 at another end thereof as illustrated in FIG. 20A. The drive shaft 602 and the coupling member 603 are engaged in such a manner as to be capable of transmitting the driving force each other, and in such a manner that the coupling member 603 is movable in a direction "a" or a direction "b" indicated by arrows shown in FIG. 20A.

Figure 20B:
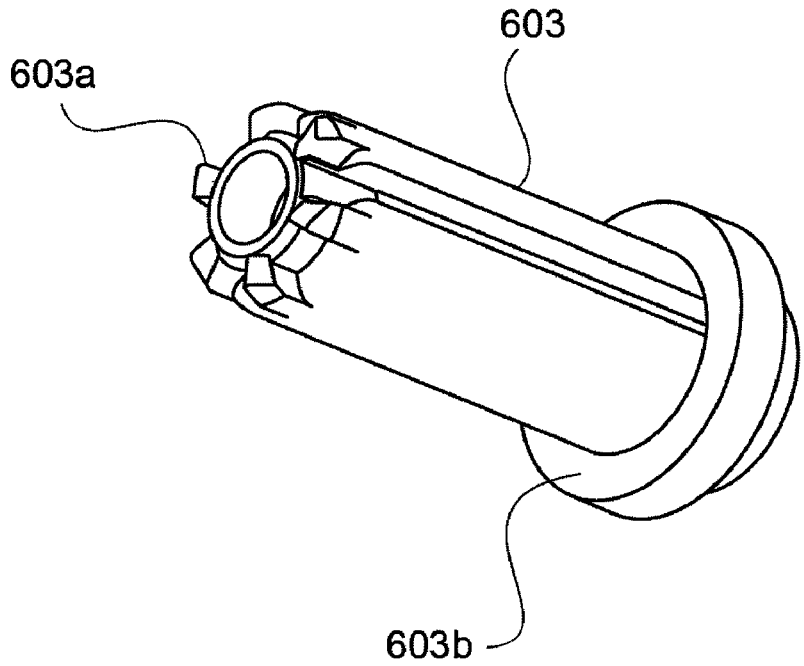
FIG. 20B is a schematic diagram illustrating a coupling member of the front feed device according to the fourth embodiment.
Figure 20C:
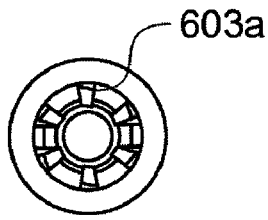
FIG. 20C is a side view illustrating the coupling member of FIG. 20B.

The coupling member 603 is molded from synthetic resin, for example, and includes a coupling portion 603*a* capable of engaging with the couple portion 601*c* on the side of one end thereof and a flange portion 603*b* latching the spring 604 and contacting a cam 605*f* disposed to the cover 605 as illustrated in FIG. 20B. Therefore, the coupling member 603 is movable in the directions "a" and "b" indicated by the arrows shown in FIG. 20A corresponding to the opening and closing operation of the cover 605. For example, the coupling member 603 moves in the direction "a" shown in FIG. 20A, thereby engaging with the front feed roller 601. On the other hand, the coupling member 603 moves in the direction "b" shown in FIG. 20A, thereby disengaging with the front feed roller 601. The coupling member 603 having the coupling portion 603*a* is illustrated in a side view of FIG. 20C.

The spring 604 is made of a material, for example, SUS (i.e., stainless used steel standardized by Japanese Industrial Standards). The spring 604 serving as an urging member is disposed between the stopper 602*c* and the flange portion 603*b* of the coupling member 603.

Figure 21:
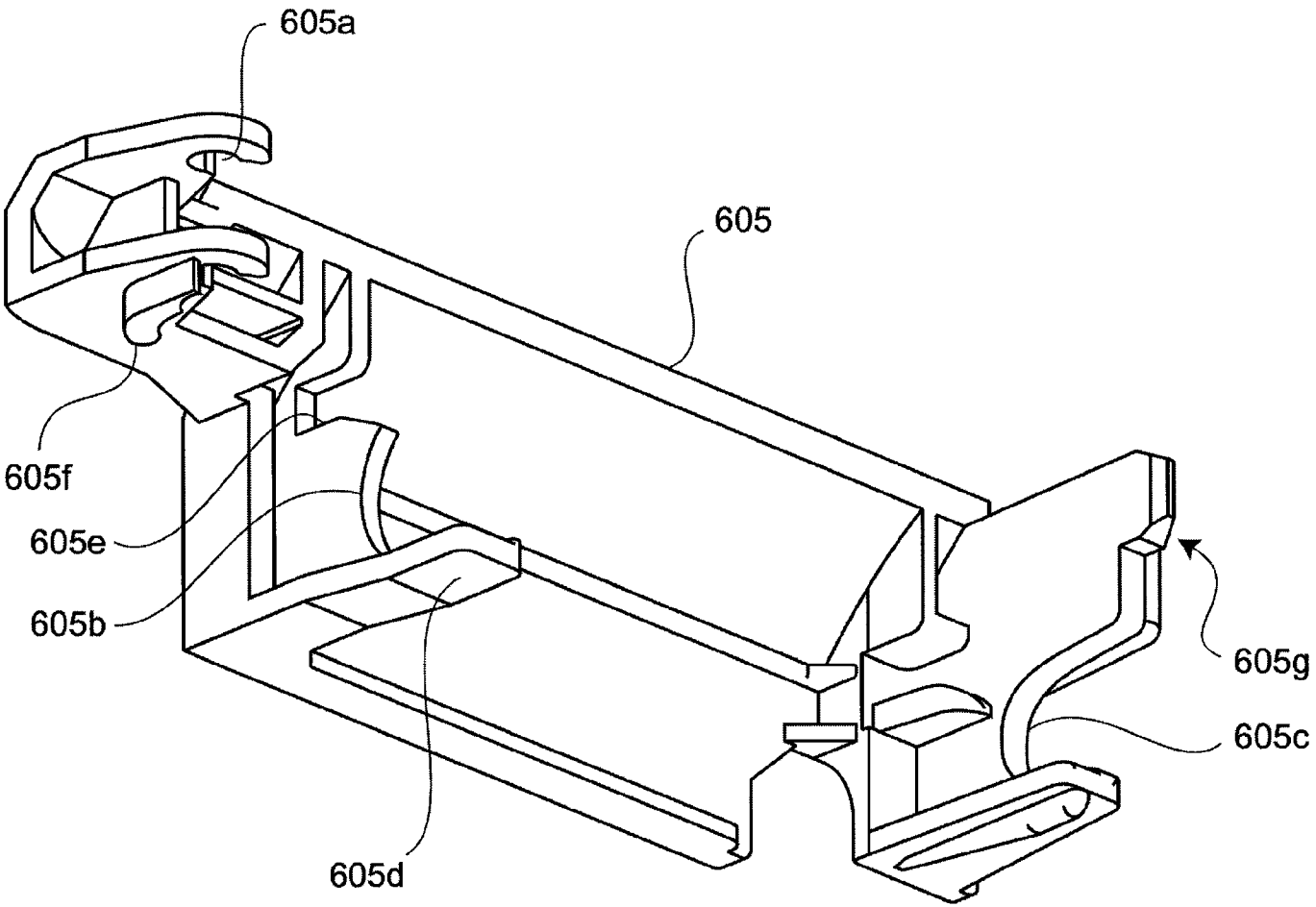
FIG. 21 is a schematic diagram illustrating a cover of the front feed device according to the fourth embodiment.
Figure 22:
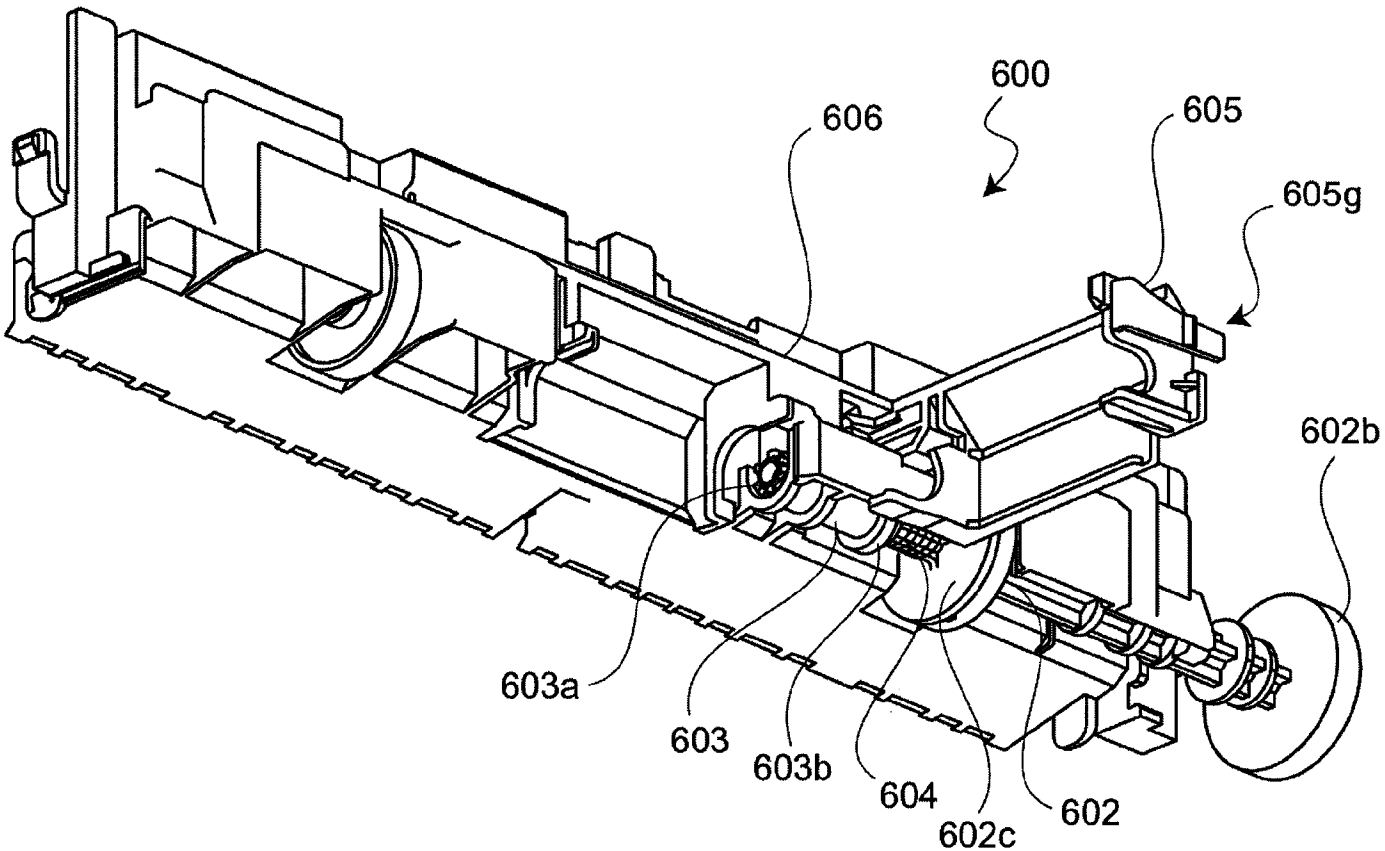
FIG. 22 is another schematic diagram illustrating the front feed device according to the fourth embodiment.

Referring to FIG. 21, the cover 605 is illustrated. The cover 605 is molded from synthetic resin, for example, and includes a rotatable tab 605*a* on the side of one end thereof and the cam 605*f* in the vicinity of the rotatable tab 605*a* as illustrated in FIG. 21. The rotatable tab 605*a* rotatably engages with a rotatable shaft 606*a* disposed to the frame 606, and the cam 605*f* contacts the flange portion 603*b* of the coupling member 603 and allows the coupling member 603 to move in the directions "a" or "b" indicated by arrows shown in FIG. 20A corresponding to the opening and closing operation of the cover 605. As illustrated in FIG. 21, the cover 605 includes reentrant portions 605*b* and 605*c* corresponding to shapes of the shaft members 601L and 601R serving as both end shafts of the front feed roller 601. The cover 605 includes a tab 605*g* on the side of another end thereof. In a case where the cover 605 is closed, the tab 605*g* is latched on a latching portion 606*h* disposed to the frame 606 as illustrated in FIG. 22. Therefore, the cover 605 can remain closed without opening thereof by the external force applied to the front feed roller 601. In case where the tab 605*a* is pushed down, the cover 605 can be open.

Figure 23:
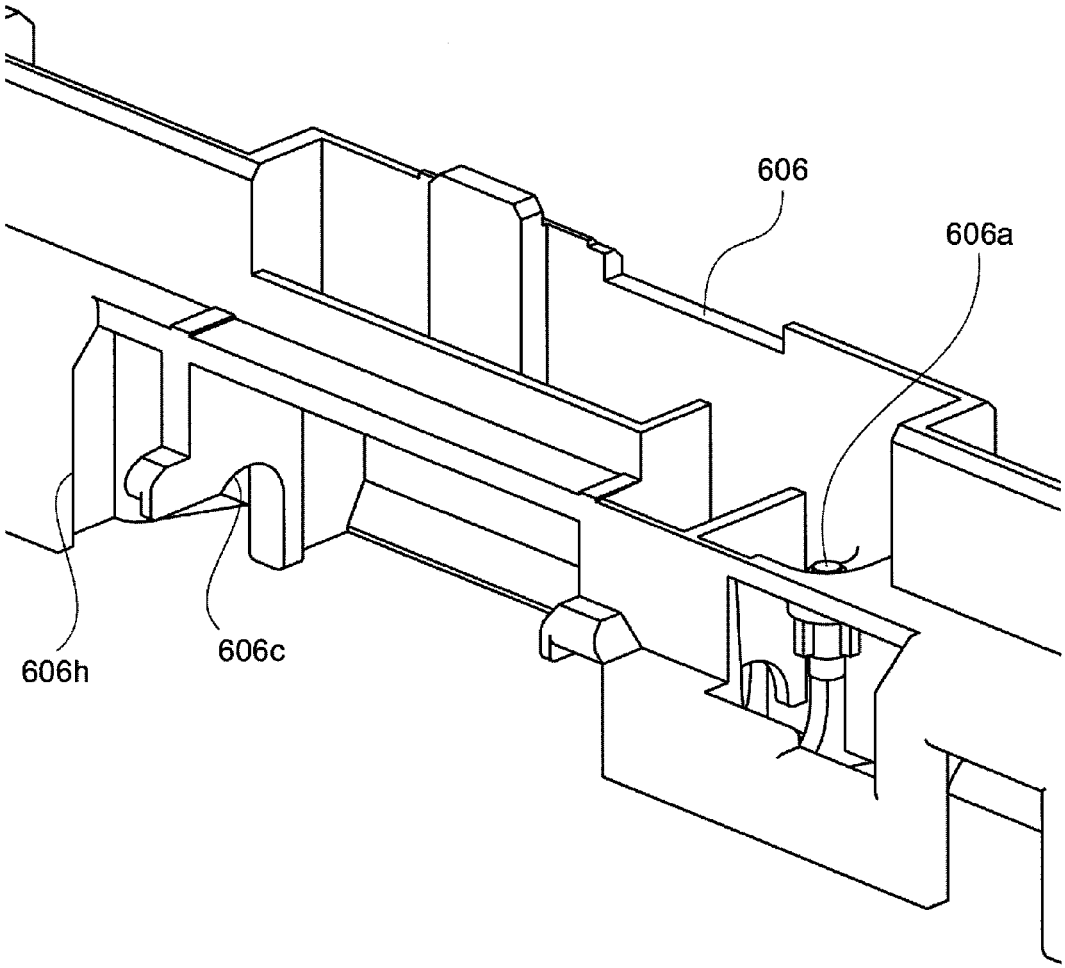
FIG. 23 is an enlarged partial view illustrating a frame of the front feed device according to the fourth embodiment.
Figure 24:
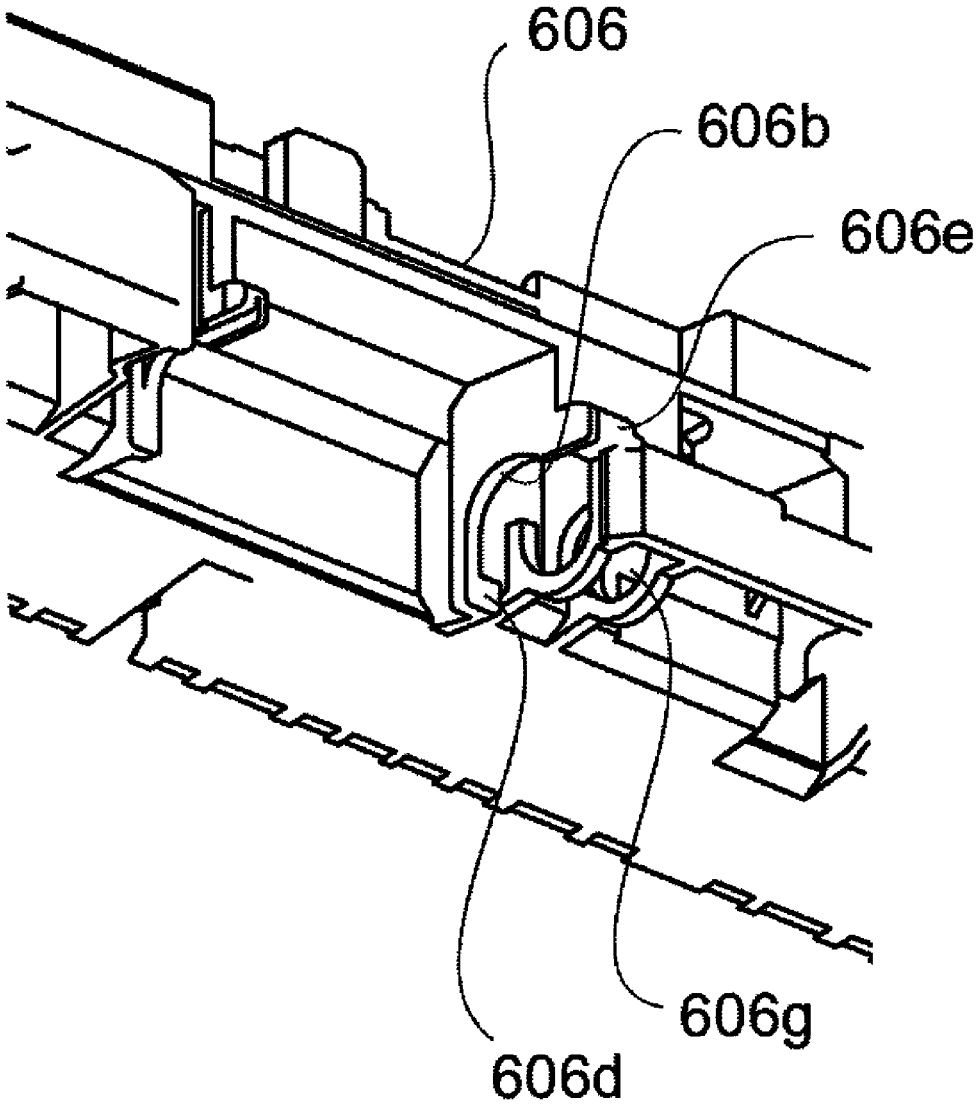
FIG. 24 is another enlarged partial view illustrating the frame.

The frame 606 serving as an outside housing of the front feed device 600 is molded from synthetic resin, for example, and supports the drive shaft 602, the cover 605, and the like. As illustrated in FIG. 23, the frame 606 includes the rotatable shaft 606*a* rotatably engaging with the rotatable tab 605*a* of the cover 605 and the latching portion 606*h* latching the tab 605*a* of the cover 605, thereby rotatably supporting the cover 605. Moreover, the frame 606 includes the reentrant portions 606*b* and 606*c* corresponding to the shapes of the shaft members 601L and 601R serving as the both end shafts of the front feed roller 601 as illustrated in FIGS. 23 and 24. A cylindrical portion 606*g* is disposed below the rotatable shaft 606*a* in such a manner that the coupling member 603 rotates and slidably contacts with respect to an axial direction.

Figure 25:
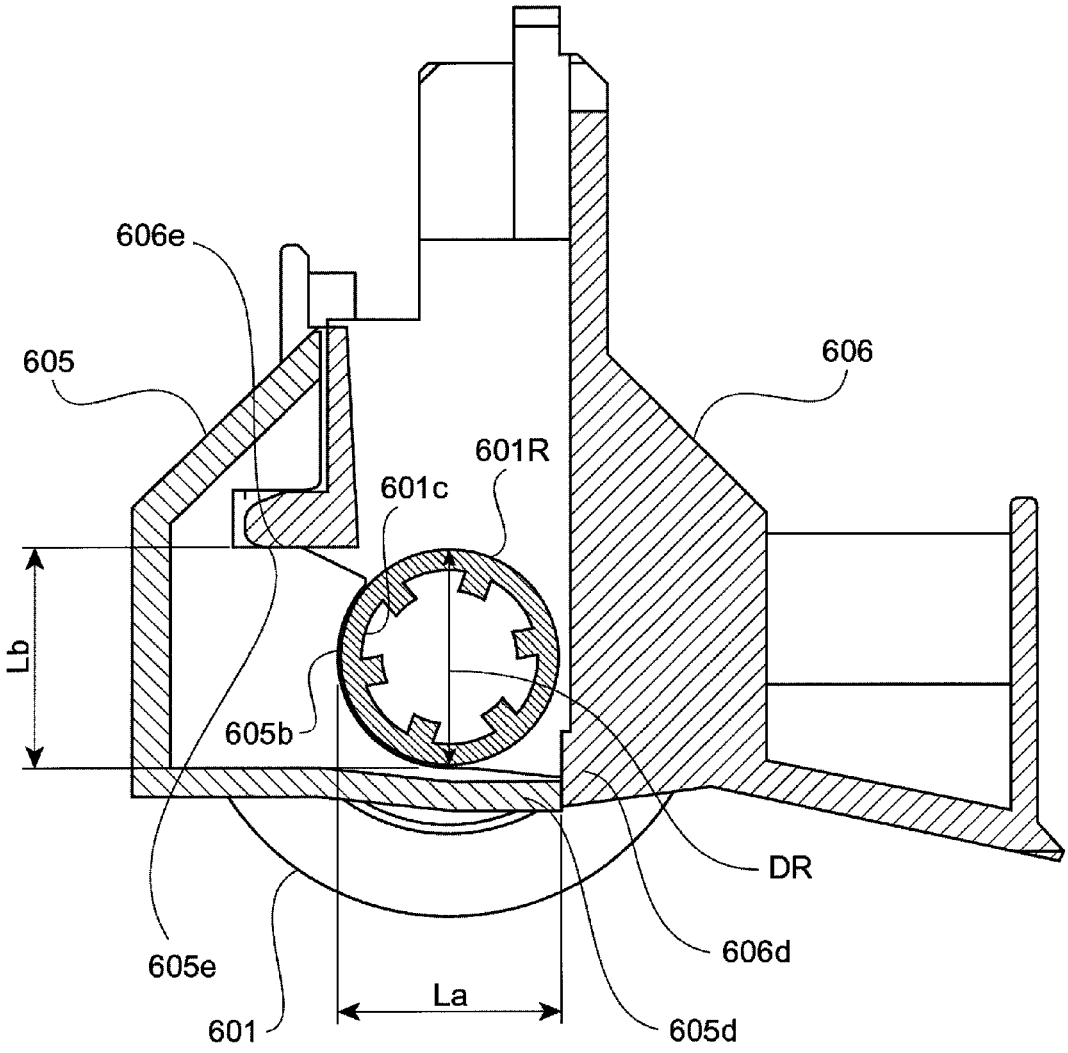
FIG. 25 is a cross-sectional view taken from a line I-I of FIG. 18.

Referring to FIG. 25, the front feed device 600 is illustrated in a cross sectional view taken along the line I-I of FIG. 18. A circumference portion of the shaft member 601R of the front feed roller 601 rotatably supported by the reentrant portions 605*b* and 605*c* disposed to the cover 605 and the reentrant portions 606*b* and 606*c* disposed to the frame 606 is explained with reference to FIG. 25. In a case where the cover 605 is closed as illustrated in FIG. 25, a contact portion 605*d* of the cover 605 contacts a contact portion 606*d* of the frame 606, and a contact portion 605*e* of the cover 605 contacts a contact portion 606*e* of the frame 606. Herein, a relationship among the outside diameter "DR" of the shaft member 601R of the front feed roller 601 and measurements are expressed as follows.

$$La=Lb>DR,$$

where a value "La" represents the measurement from a contact position of the contact portion 605*d* the contact portion 606*d* to the reentrant portion 605*b* of the cover 605, and a value "Lb" represents the measurement from a contact position of the contact portion 605*e* and the contact portion 606*e* to the reentrant portion 605*b* of the cover 605. Such a relationship is arranged to be satisfied. Therefore, the front feed roller 601 is rotatably supported without being pressed by the cover 605 and the frame 606. Since the shaft member 601L of the front feed roller 601 is disposed similar to the shaft member 601R, the description of the shaft member 601L is omitted for the sake of simplicity.

Figure 26:
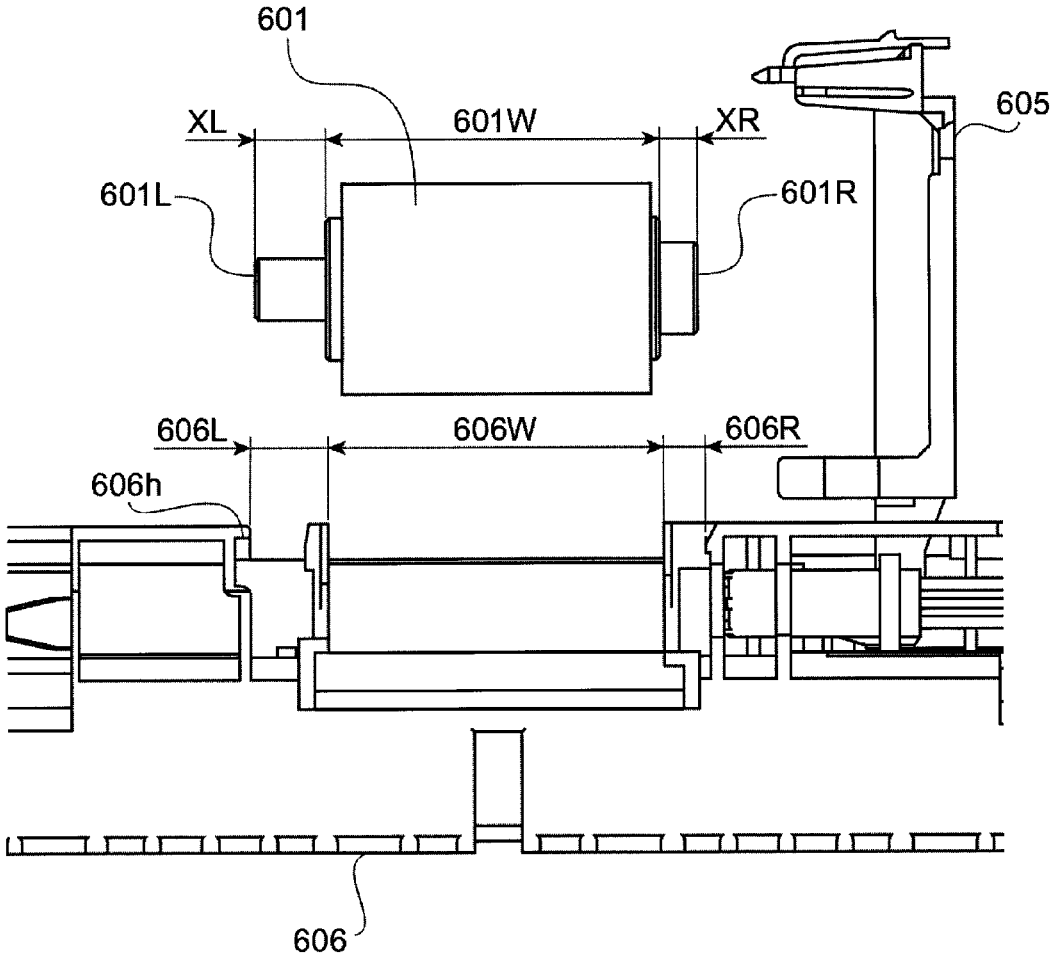
FIG. 26 is a diagram illustrating a measurement of the front feed roller in an axial direction and a measurement of an attachment place of the front feed roller on the frame of the front feed device according to the fourth embodiment.

Referring to FIG. 26, a measurement of the front feed roller 601 in the axial direction and a measurement of an attachment place of the frame 606 to be attached with the front feed roller 601 are illustrated. The relationships of such measurements are expressed as follows.

$$601W<606W,$$

$$601W+XL>606W+606R,$$

where a value "606W" represents a width measurement of the frame 606 to be attached with the boss 601*a* of the front feed roller 601, a value "606R" represents a width measurement of the frame 606 to be attached with the shaft member 601R, and a value "606L" represents a width measurement of the frame 606 to be attached with the shaft member 601L as illustrated in FIG. 26. Such relationships are arranged to be satisfied. Therefore, in a case where the user attempts to attach the front feed roller 601 to the frame 606 in a left and right reverse manner, the front feed roller 601 is not attached due to intervention of the long shaft member 601L in the frame 606, thereby reducing an improper attachment of the front feed roller 601.

Now, the movement operation of the coupling member 603 corresponding to the opening and closing operation of the cover 605 is described with reference to FIGS. 27, 28, and 29.

Figure 27:
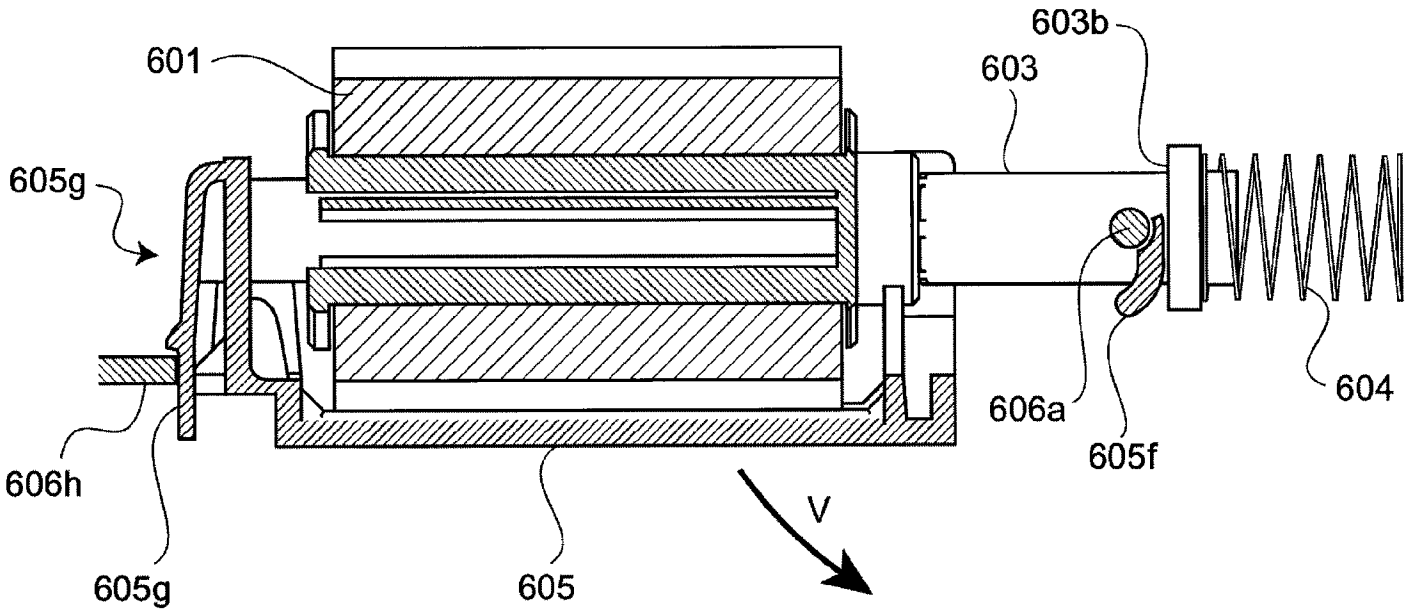
FIG. 27 is a diagram illustrating opening and closing operation of the cover.

As illustrated in FIG. 27, the cam 605*f* of the cover 605 and the flange portion 603*b* of the coupling member 603 do not contact each other, and the coupling member 603 is connected to the front feed roller 601 by the urging force of the spring 604 in a state that the cover 605 is closed.

Figure 28:
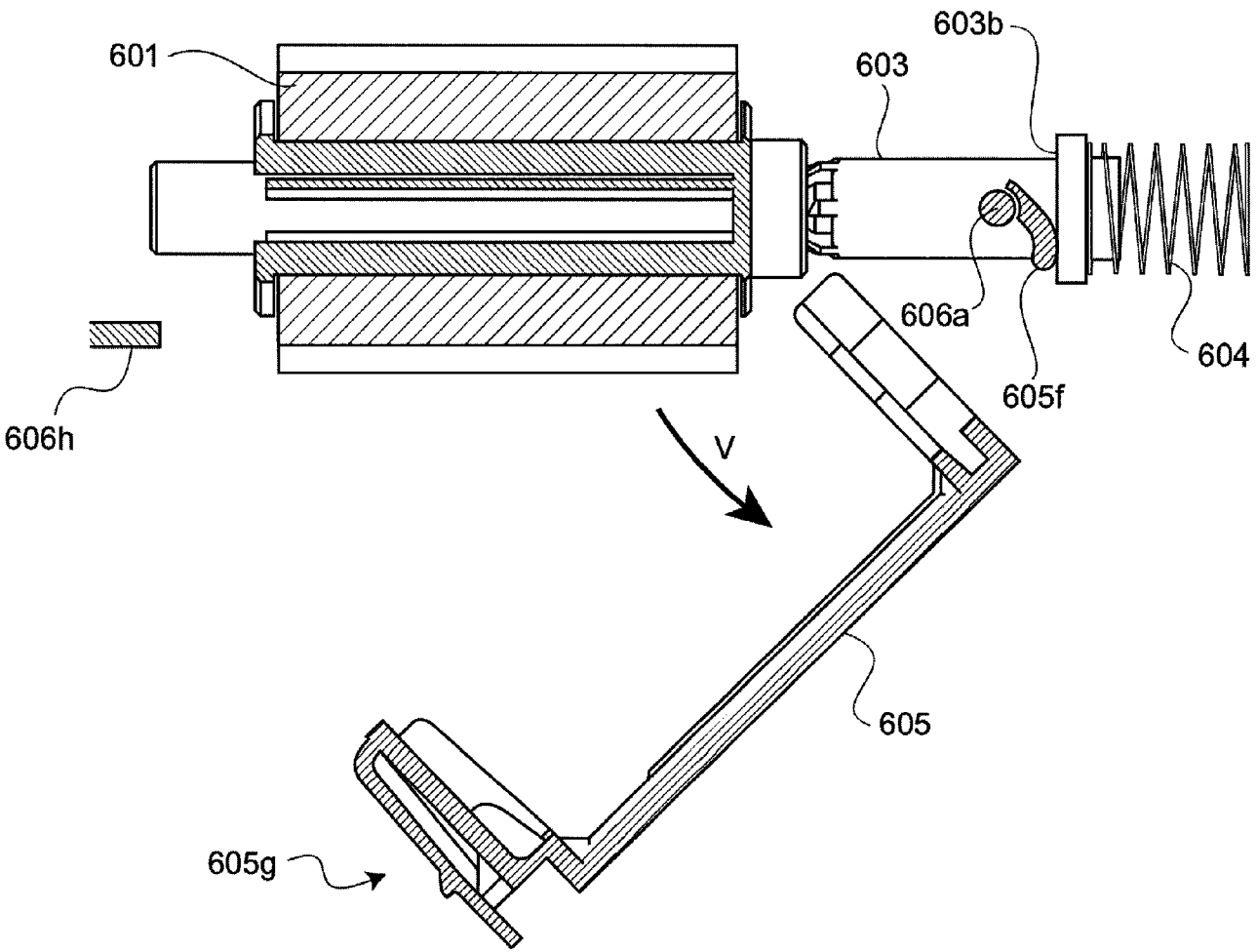
FIG. 28 is another diagram illustrating the opening and closing operation of the cover.

In a case where the tab 605*g* of the cover 605 is pushed down and open by the user in a direction "V" indicated by an arrow shown in FIG. 28, the cam 605*f* of the cover 605 pushes down the flange portion 603*b* of the coupling member 603 in a direction in which the spring 604 is compressed, thereby disengaging the coupling member 603 with the front feed roller 601.

Figure 29:
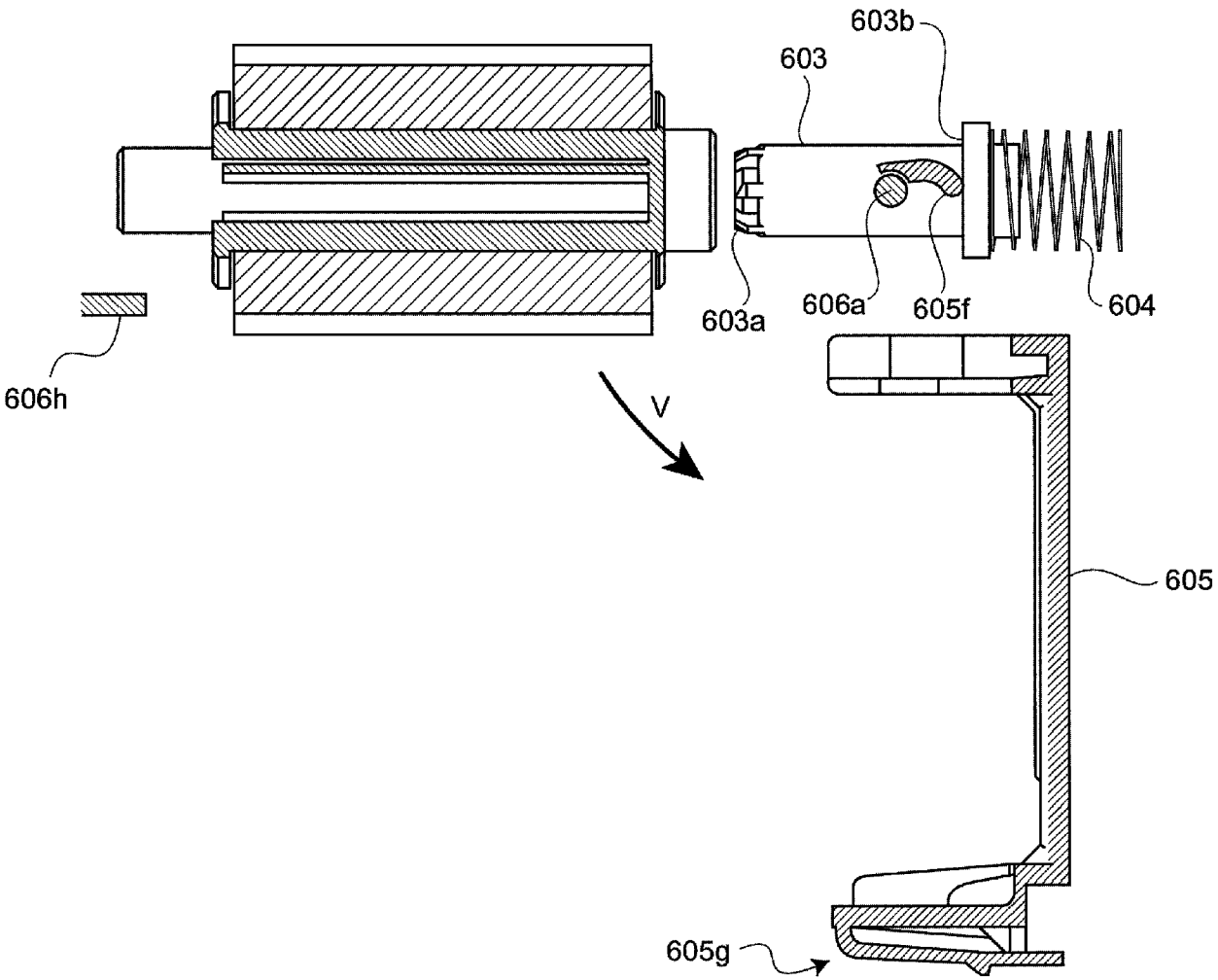
FIG. 29 is yet another diagram illustrating the opening and closing operation of the cover.

Moreover, in a case where the cover 605 is open in a direction "V" indicated by an arrow shown in FIG. 29, the coupling member 603 and the front feed roller 601 are completely disengaged, so that the front feed roller 601 is completely exposed. Consequently, the front feed roller 601 can be detached.

The operation of detaching the front feed roller 601 is described with reference to FIGS. 30, 31, and 32.

Figure 30:
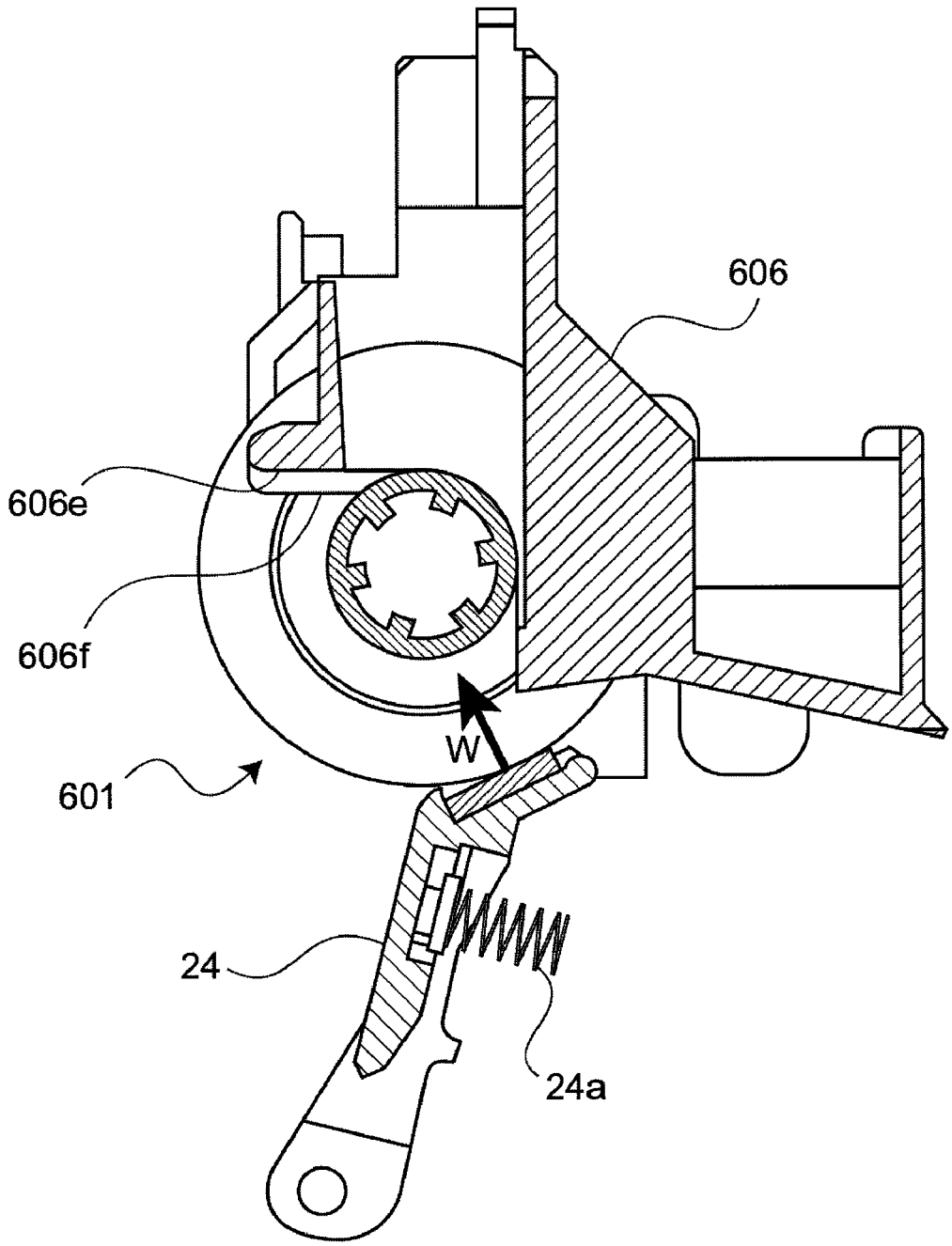
FIG. 30 is a diagram illustrating operation of detaching the front feed roller according to the fourth embodiment.

FIG. 30 illustrates the front feed roller 601 in a state that the cover 605 is completely open. The front feed roller 601 is urged in a direction "W" indicated by an arrow shown in FIG. 30 by the urging force of a separation member 24 applied by a spring 24*a*. However, the front feed roller 601 remains attached to the frame 606 by a protrusion portion 606*f* disposed to the frame 606.

Figure 31:
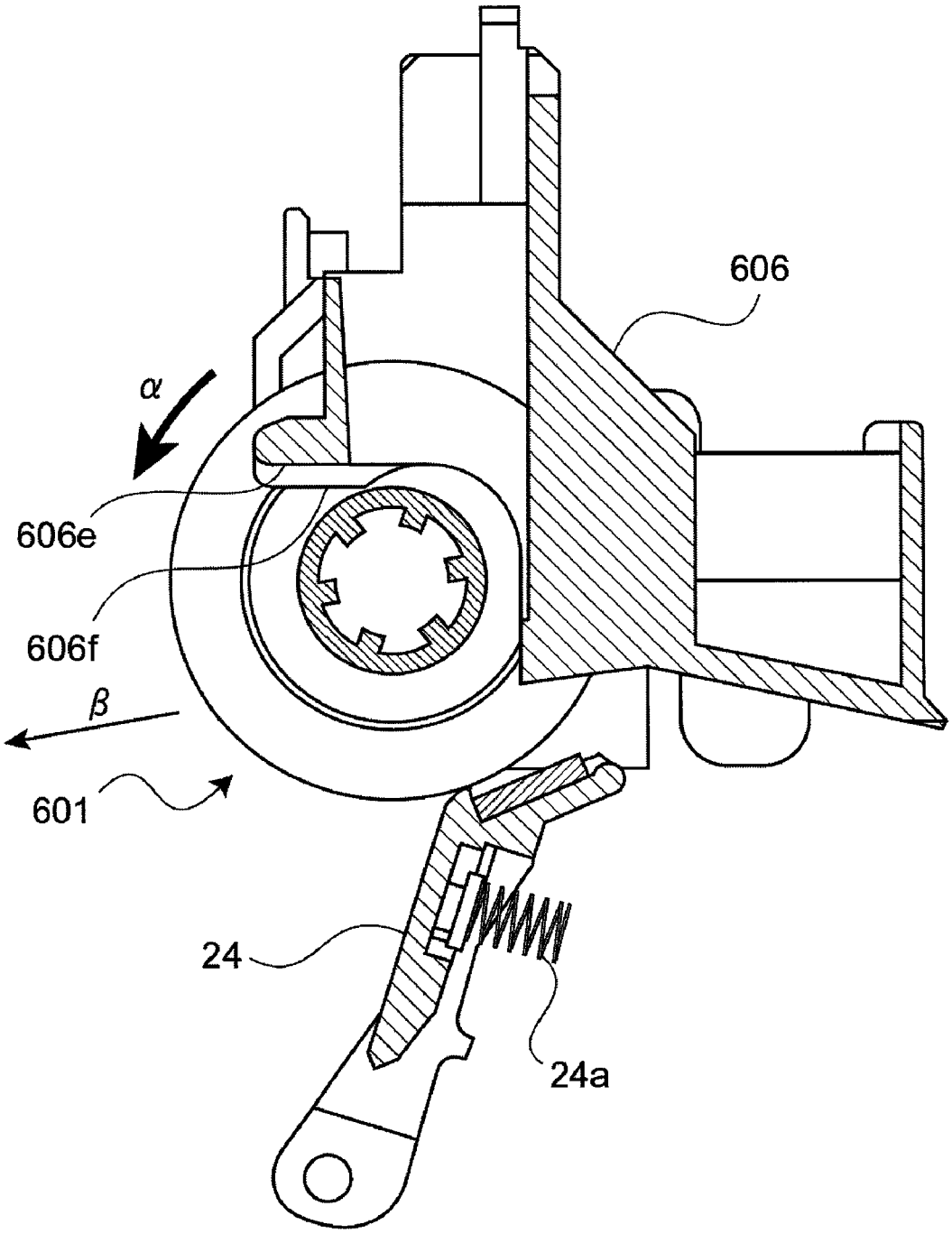
FIG. 31 is another diagram illustrating operation of detaching the front feed roller according to the fourth embodiment.

In a case where the front feed roller 601 is slightly rotated by the user in a direction "a" indicated by an arrow shown in FIG. 31, the front feed roller 601 begins to rotate in a direction "P" by the friction force between the separation member 24 and the rubber roller 601*b*. In a case where the front feed roller 601 is further rotated, the front feed roller 601 overpasses the protrusion portion 606*f* disposed to the frame 606.

Figure 32:
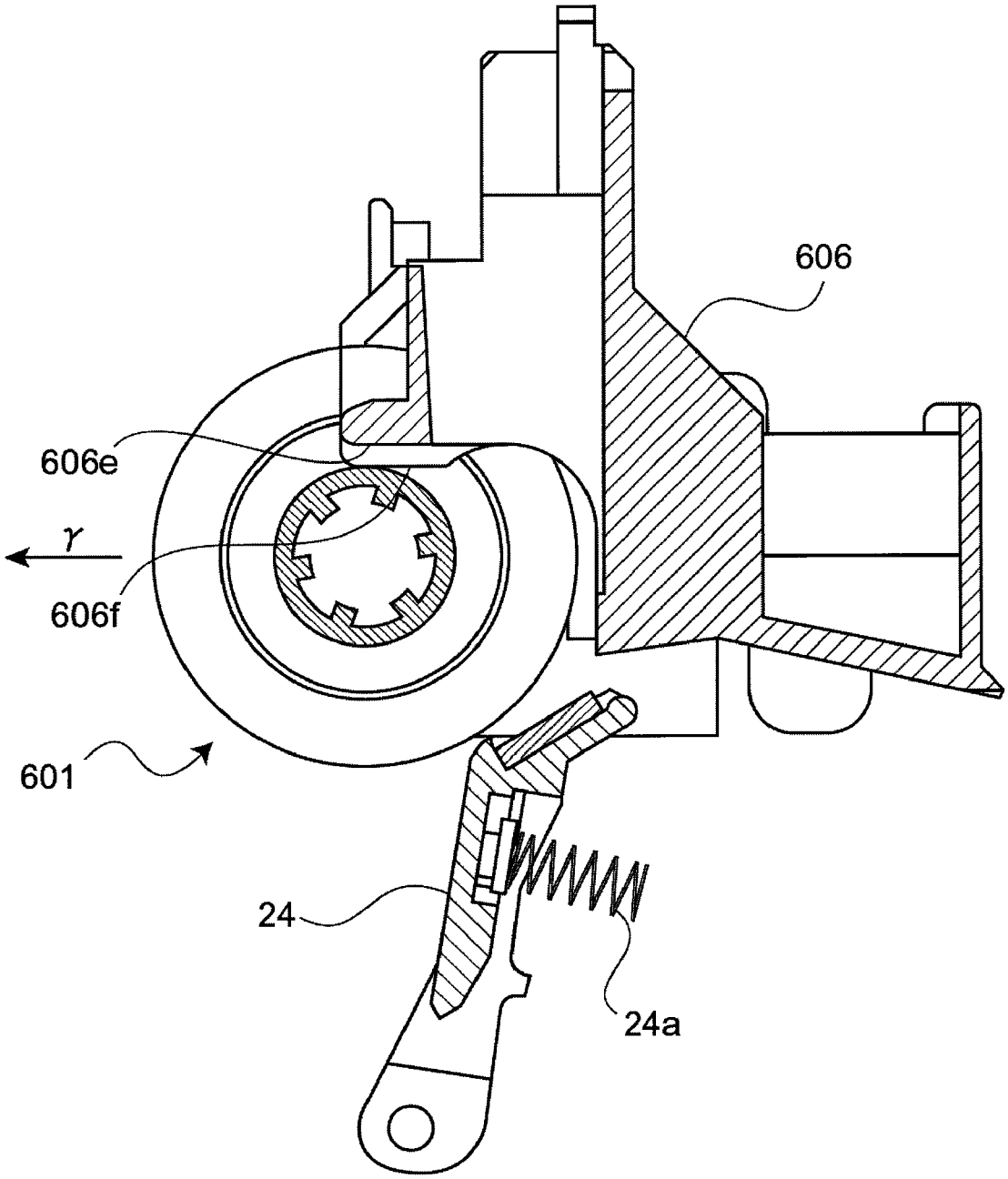
FIG. 32 is yet another diagram illustrating operation of detaching the front feed roller according to the fourth embodiment.

FIG. 32 illustrates the front feed roller 601 in a state that the front feed roller 601 completely overpasses the protrusion portion 606*f* disposed to the frame 606. The front feed roller 601 is pushed in a direction "y" indicated by an arrow shown in FIG. 32 by the urging force of the separation member 24, and is detached from the frame 606 thereby.

In a case where the front feed roller 601 is attached to the frame 606, a reverse procedure of the operation of detaching the front feed roller 601 described above is performed. That is, in a case where the front feed roller 601 is pushed against the urging force of the separation member 24, the front feed roller 601 returns to the state described with reference to FIG. 30 through the state described with reference to FIG. 31. In FIG. 30, the front feed roller 601 remains attached to the frame 606 by the protrusion portion 606*f* disposed to the frame 606 as described above. Therefore, the user can easily attach the front feed roller 601 to the frame 606. In a case where the cover 605 is closed by the user, the tab 605*g* disposed to the cover 605 is latched on the latching portion 606*h* of the frame 606, so that the front feed roller 601 is rotatably supported by the cover 605.

Herein, in a case where the coupling portion 603*a* of the coupling member 603 and a phase of the concavity and convexity of the coupling portion 601*c* of the front feed roller 601 are not congruent each other, the coupling portions 603*a* and 601*c* are not engaged each other. However, in a case where feeding operation begins, the coupling member 603 and/or the front feed roller 601 begin to rotate, thereby engaging the coupling portions 603*a* with 601*c*. In a case where the front feed roller 601 is attached to the frame 606 as described above, the front feed roller 601 cannot be attached in a left and right reverse manner.

According to the fourth embodiment described above, in a case where the cover 605 is completely open, the front feed roller 601 and the coupling member 603 are completely separated, and the positional support of the front feed roller 601 is released, thereby reducing the necessity of congruence between the phase of the coupling portion 601*a* and the coupling portion 603*a*. Moreover, the user can easily replace the front feed roller 601 without the necessity of special operation such as inclination and insertion of the front feed roller 601. Moreover, since the phase of the coupling portion does not need to be controlled, the fourth embodiment can be applied to any feed mechanism.

Fifth Embodiment

A printer 5001 and print operation according to a fifth embodiment are substantially similar to the printer 1' and the print operation of the fourth embodiment described above. Components of the printer 5001 and the print operation that differ from those of the above fourth embodiment will be described, and like components will be given the same reference numerals as above and description thereof will be omitted for the sake of simplicity.

Figure 33:
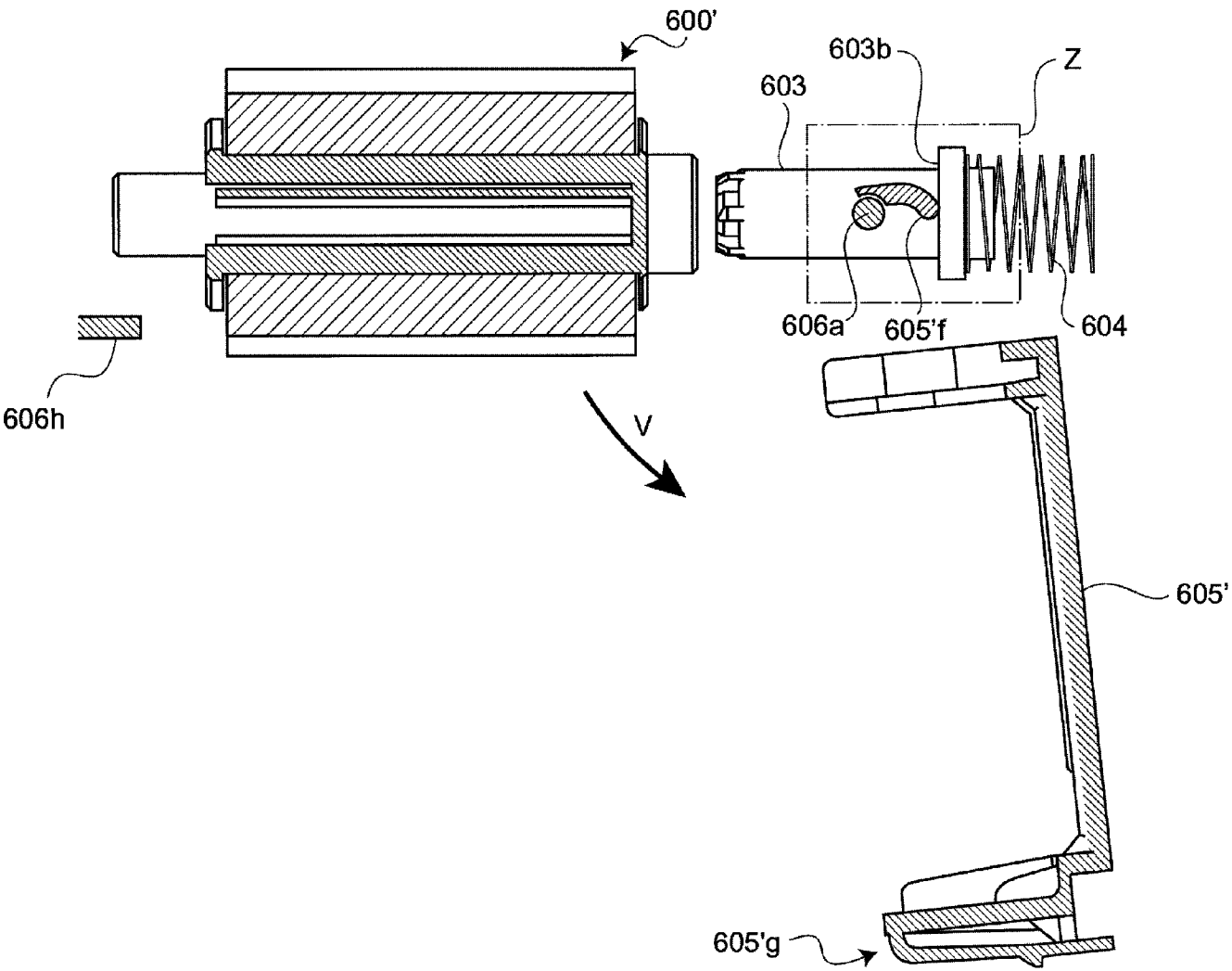
FIG. 33 is a diagram illustrating opening and closing operation of a cover according to a fifth embodiment of the present invention.
Figure 34:
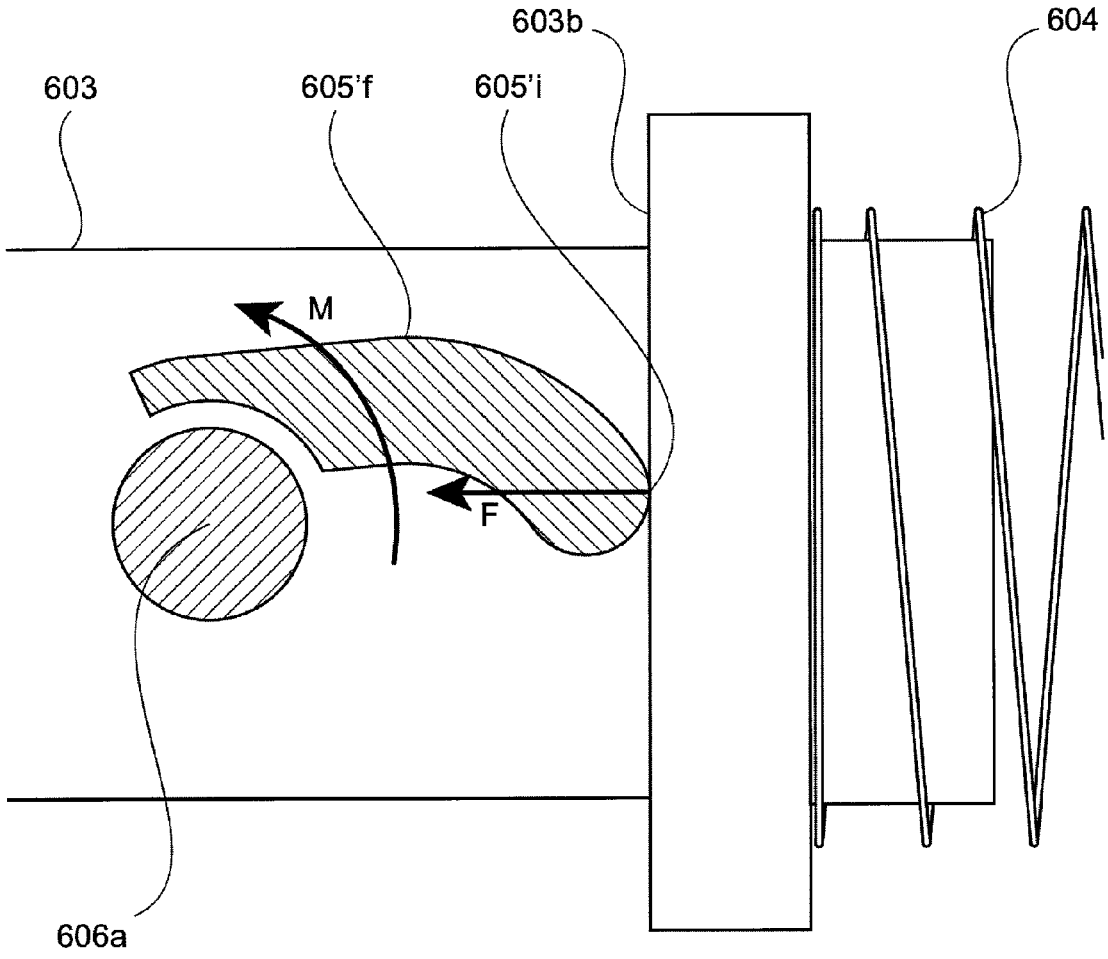
FIG. 34 is another diagram illustrating the opening and closing operation of the cover according to the fifth embodiment of the present invention.

Referring to FIG. 33, opening and closing operation of a cover 605' included in a front feed device 600' according to the fifth embodiment is illustrated. An area Z indicated by a chain line of FIG. 33 is enlarged in FIG. 34. A cam 605'*f* of the cover 605' is disposed in a contact position with a flange portion 603*b* of a coupling member 603 in such a manner as to be slightly different from the position of the cam 605*f* included in the cover 605 according to the above fourth embodiment. That is, the cam 605'*f* of the cover 605' contacts the flange portion 603*b* of the coupling member 603 and is disposed in a position 605'*i* in which the cam 605'*f* is applied with reaction force "F" from the flange portion 603*b* as illustrated in FIG. 34. Therefore, in a case where the cover 605' is open to a prescribed position as illustrated in FIG. 33, a moment "M" shown in FIG. 34 is applied in a direction in which the cover 605' is open as indicated by an arrow, so that the cover 605' can remain open.

According to the fifth embodiment described above, since the cover 605' is open to the prescribed position and remains open, a user can reduce the labor such as holding the cover 605' with a hand thereof in a case of replacement of a front feed roller 601. Therefore, the user can more easily replace the front feed roller 601.

According to each of the first, second, third, fourth, and fifth embodiments described above, the cam mechanism is used as an engagement and disengagement mechanism of the engagement and disengagement member. However, the engagement and disengagement mechanism is not limited thereto. For example, a worm gear and a gear wheel may be disposed to the coupling member and the rotatable shaft of the cover member, respectively, and a mechanism engaging and disengaging the drive shaft with the feed roller member may be employed to engage and disengage the drive shaft with the feed roller member by meshing the worm gear with the gear wheel corresponding to opening and closing of the cover member.

According to each of the first, second, third, fourth, and fifth embodiments described above, the electrophotographic printer employing the LED method is used as an example. However, each of the embodiments of the present invention is not limited thereto. For example, an electrophotographic printer with a laser method employing an intermediate transfer method may be used. Moreover, the present invention is not limited to the electrophotographic printer, and may be applied to an image forming apparatus such as a facsimile machine, a photocopier, and a multi-functional peripheral. Moreover, the replacement of the front feed roller is described in each of the above embodiments of the present invention. However, the present invention is not limited to thereto. For example, the present invention may be applied to replacement of a roller such as a feed roller, an ejection roller, a conveyance roller, a heat roller, a pressure roller, a variety of rollers included in an image forming unit such as a roller of a photosensitive drum, and a transfer roller.

According to the above embodiments of the present invention, a friction separation method including the feed roller and a separation member is described as an example. However, the present invention is not limited to the friction separation method. For example, the present invention may be applied to a feed method such as a semi-retard method and a retard method.

The present invention has been described above with regard to particular embodiments, but the present invention is not limited thereto. As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A feed device comprising:

a shaft being rotatably supported;

a roller member engaging with one end portion of the shaft through an engagement and disengagement member; and a cover member covering the roller member in an openable and closable manner and supporting the roller member, wherein the engagement and disengagement member engages and disengages the shaft with the roller member upon movement of the engagement and disengagement member outwardly from one end portion of the roller member linearly along an axial direction of the roller member corresponding to opening and closing of the cover member.

2. The feed device according to claim 1, wherein the cover member controls engagement and disengagement by the engagement and disengagement member based on a cam mechanism.

3. The feed device according to claim 1, wherein the engagement and disengagement member engages and disengages the shaft with the roller member based on a coupling mechanism.

4. The feed device according to claim 1, wherein the cover member is secured in a prescribed operation position.

5. The feed device according to claim 1, comprising:

an exterior member capable of being stored and also serving as a medium stacking portion, wherein the engagement and disengagement member engages and disengages the shaft with the roller member by closing the cover member with storing operation of the exterior member.

6. The feed device according to claim 2, comprising:

an urging member disposed between the shaft and the cam mechanism, wherein the engagement and disengagement member is urged on a side of the roller member by the urging member.

7. The feed device according to claim 6, wherein the cam mechanism includes:

an operation portion, disposed to the engagement and disengagement member, contacting the urging member and having an inclination portion inclined with respect to an axial line direction of the roller member; and a cam, disposed to the cover member, contacting the inclination portion, wherein the cam presses the inclination portion in a direction compressing the urging member by operation of the cover member.

8. The feed device according to claim 6, wherein the cam mechanism includes:

a flange portion, disposed to the engagement and disengagement member, contacting the urging member; and a cam contacting the flange member disposed to the cover member in such a manner as to be opposite to the engagement and disengagement, wherein the cam presses the flange portion in a direction compressing the urging member by operation of the cover member.

9. An image forming apparatus comprising:

a feed device including:

a shaft being rotatably supported;

a roller member engaging with one end portion of the shaft through an engagement and disengagement member; and a cover member covering the roller member in an openable and closable manner and supporting the roller member, wherein the engagement and disengagement member engages and disengages the shaft with the roller member upon movement of the engagement and disengagement member outwardly from one end portion of the roller member linearly along an axial direction of the roller member corresponding to opening and closing of the cover member.

10. The feed device according to claim 1, wherein an other end portion of the roller member is detachably engaged on the cover member, and in a case where the cover member is open and closed, the engagement and disengagement member moves toward the roller member in the axial direction while the other end portion of the roller member remains engaged.

11. The feed device according to claim 10, wherein, in a case where the cover member moves in an open direction, an end portion of the shaft is disengaged from the one end portion of the roller member while the other end portion of the roller member remains engaged by the cover member.

12. The feed device according to claim 1, wherein the cover member moves pivotally around an axis of the roller member, and the engagement and disengagement member moves in a direction perpendicular to a rotation direction of the cover member as the cover member moves pivotally.

* * * * *